US008733889B2

(12) United States Patent
Uemura

(10) Patent No.: US 8,733,889 B2
(45) Date of Patent: May 27, 2014

(54) CLEANING DEVICE, LIQUID APPLICATION DEVICE AND IMAGE FORMING APPARATUS

(75) Inventor: Hiroshi Uemura, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 735 days.

(21) Appl. No.: 12/874,278

(22) Filed: Sep. 2, 2010

(65) Prior Publication Data

US 2011/0050801 A1 Mar. 3, 2011

(30) Foreign Application Priority Data

Sep. 3, 2009 (JP) ..... 2009-203731

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

U.S. PATENT DOCUMENTS

| | | | | |
|---|---|---|---|---|
| 6,630,035 | B1 | 10/2003 | Sato et al. | |
| 2009/0079784 | A1 | 3/2009 | Chiwata et al. | |
| 2010/0231674 | A1 * | 9/2010 | Domoto et al. | 347/103 |

FOREIGN PATENT DOCUMENTS

| | | | |
|---|---|---|---|
| JP | 6-143545 | A | 5/1994 |
| JP | 7-329287 | A | 12/1995 |
| JP | 10-95104 | A | 4/1998 |
| JP | 11-70641 | A | 3/1999 |
| JP | 2001-121785 | A | 5/2001 |
| JP | 2009-96175 | A | 5/2009 |

OTHER PUBLICATIONS

Japanese Notification of Reasons for Rejection for Japanese Application No. 2010-190740, dated Jan. 14, 2014, along with a partial English translation.

* cited by examiner

*Primary Examiner* — Kevin S Wood
(74) *Attorney, Agent, or Firm* — Birch, Stewart, Kolasch & Birch, LLP

(57) ABSTRACT

The cleaning device includes: a wiper blade which is arranged along an axial direction of a pressure drum holding and conveying a medium on which liquid is applied, the pressure drum holding the medium on a pressure drum circumferential surface of the pressure drum and conveying the medium in a prescribed medium conveyance direction, the wiper blade wiping and removing the liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction; a movement device which moves the wiper blade so as to separate the wiper blade from the pressure drum circumferential surface when a gripping member arranged on the pressure drum to hold an end portion of the medium passes a wiping process position of the wiper blade; and a liquid pool removal device which removes at least a portion of the liquid in a liquid pool formed by the liquid that has been wiped by the wiper blade immediately before the wiper blade is separated from the pressure drum circumferential surface and that has not slid completely down the wiper blade face.

14 Claims, 22 Drawing Sheets

CLEANING DEVICE, LIQUID APPLICATION DEVICE AND IMAGE FORMING APPARATUS

BACKGROUND OF THE INVENTION

1. Field of the Invention

The present invention relates to a cleaning device, a liquid application device and an image forming apparatus, and more particularly to cleaning technology for a conveyance device which holds and conveys a medium.

2. Description of the Related Art

With the object of forming good images in a cut sheet printing system of a general printing machine in which image formation is carried out using an inkjet method, there is a process of applying an aggregating reaction liquid (hereinafter referred to as a "treatment liquid") using roller application in a stage before image formation using ink, thereby forming an inkjet receiving layer on standard printing paper. In an image forming process based on an inkjet recording method, it is desirable to use a roller application method for applying the treatment liquid in order to form a thin layer of treatment liquid having low viscosity over the whole surface of a recording medium.

FIG. 25 is an illustrative diagram showing a schematic view of a treatment liquid application process which employs a roller application method using an application roller. As shown in FIG. 25, in order to form a borderless image over the whole surface of a recording medium 604 held on a conveyance drum surface (circumferential surface) 600A of a conveyance drum 600, it is necessary to apply treatment liquid over a region broader than a region where the image is formed, and therefore the width of the application roller 606, which applies the treatment liquid, is greater than the width of the recording medium 604. The region defined with dashed lines in FIG. 25 is the region where the treatment liquid is applied on the conveyance drum surface 600A, and here the treatment liquid is applied to the outside of the recording medium 604.

The treatment liquid having been excessively applied (hereinafter referred to as "excess treatment liquid") accumulates as the printing continues, and when the accumulated amount of the excess treatment liquid becomes greater than the amount that can be held on the conveyance drum surface 600A, the excess treatment liquid starts to trickle down the conveyance drum surface 600A. If the excess treatment liquid trickling down the conveyance drum surface 600A (hereinafter referred to as "trickling excess treatment liquid") adheres to the successively conveyed recording media, then this leads to decline in print quality. Furthermore, if the trickling excess treatment liquid adheres to the conveyance mechanism, such as grippers, which grip the leading end portion of the recording medium 604, then this not only gives rise to conveyance abnormalities of the recording medium, such as jams, but also causes problems such as corrosion of the conveyance drum itself and the peripheral members of the conveyance drum, such as the jacket, grippers, and the like, due to adherence of the strongly acidic treatment liquid. Therefore, it is necessary to remove the excess treatment liquid rapidly. One method proposed for removing soiling and ink adhering to a blanket drum and an ink drum of a printing machine is a method which employs a so-called cleaning cloth (web).

Japanese Patent Application Publication No. 06-143545 discloses a cylinder cleaning device composed in such a manner that the outer circumferential surface of a cylinder is cleaned by pressing a cleaning cloth that relatively moves against the outer circumferential surface of the cylinder (drum). The cylinder cleaning device is composed in such a manner that the cleaning cloth is pressed with a pad having a circular arc shape, the circular arc portion of the pad is advanced and retracted with respect to the cylinder by altering the length of the chord subtending the arc of the pad, and the cleaning cloth is thereby pressed reliably against the drum.

Japanese Patent Application Publication No. 11-070641 discloses a cleaning device for a print drum which sprays a cleaning liquid toward a pressure drum from a plurality of nozzles disposed along the axial direction of the pressure drum (print drum) and cleans the pressure drum by pressing a cleaning cloth by means of an incorporated blade.

Although the methods for wiping away soiling by pressing the cleaning cloth against the pressure drum described in Japanese Patent Application Publication Nos. 06-143545 and 11-070641 effective in wiping away ink residue, and the like, the methods are not suitable for wiping away treatment liquid that has been applied thinly over a broad area, in terms of the capacity for absorbing liquid. More specifically, the cleaning cloth becomes saturated with the liquid immediately after the start of wiping, the cleaning cloth that has reached liquid saturation displays a massive decline in cleaning properties, and it becomes difficult to remove the liquid effectively. If using the cleaning liquid, the amount of liquid to be absorbed increases yet further, and then the removal of the treatment liquid and the cleaning liquid becomes even more difficult. In addition to this, there is also a problem in that by continuing to press the cleaning cloth that has been saturated with the liquid against the pressure drum, the liquid is caused to bleed out from the cleaning cloth and the bleeding liquid adheres again to the surface of the pressure drum.

One possible response to the above-described problems might be to wind up the portion of the cleaning cloth that has been saturated with the liquid, at a short repetition cycle (almost continuously), in such a manner that the surface is abutted with and wiped with dry cloth at all times, but since this solution consumes a very large amount of cleaning cloth, it becomes necessary to replace the cleaning cloth with great frequency, as well as being necessary to rotate the pressure drum a number of times in order to achieve sufficient cleaning. In any case, the cleaning process takes a long time, thus leading to poor efficiency.

On the other hand, another possible response might be to employ a material having a greater liquid absorption volume than the cleaning cloth (for example, a sponge sheet, sponge roller, or the like) as a wiping member. However, although sufficient liquid absorption capability is displayed for a certain period of time from the start of wiping, the wiping member reaches liquid saturation as wiping progresses, and if the wiping of the cleaning liquid is carried out over a long period of time, the problem of liquid saturation ultimately occurs similarly to when using the cleaning cloth. More specifically, even if a wiping member having a greater liquid absorption volume than the cleaning cloth is used, it becomes necessary either to frequently replace the wiping member, or to provide a separate mechanism (a vacuum sucking device, a squeezing roller, or the like) for collecting the liquid that has been absorbed by the wiping member.

As a further cleaning method, Japanese Patent Application Publication No. 10-095104 discloses a roller cleaning device for a rotary printing machine, which is composed in such a manner that cleaning is carried out while applying cleaning liquid to the circumferential surface of a swing roller, in such a manner that the cleaning liquid used for the cleaning is collected by a blade of which the edge is abutted on the circumferential surface of the swing roller.

However, removing the liquid by means of a doctor blade as described in Japanese Patent Application Publication No.

10-095104 is not suitable for a liquid that has low viscosity and is applied in an extremely thin coating of about several micrometers (μm), compared to a liquid having a certain viscosity or a liquid that has been partly cured (for example, ink soiling). In other words, the liquid passes through the clearance between the edge of the doctor blade and the pressure drum and it is difficult to remove sufficiently the liquid adhering to the pressure drum.

Furthermore, it is also possible to use a wiper blade, instead of the doctor blade. FIG. 26A is a conceptual diagram showing a schematic view of a wiping process by a doctor blade, and FIG. 26B is a conceptual diagram showing a schematic view of a wiping process by a wiper blade.

As shown in FIG. 26A, the wiping process in which a blade 622 is brought to proximity with a wiped surface 620 while being inclined against the movement direction of the wiped surface 620 (indicated with the arrowed line) is referred to as a "wiping process using a doctor blade". On the other hand, as shown in FIG. 26B, a wiping process in which the blade 622 is brought to proximity with the wiped surface 620 while being inclined along the movement direction of the wiped surface 620 (indicated with the arrowed line) is referred to as a "wiping process using a wiper blade".

In either case where the blade 622 is used as the doctor blade or the wiper blade, the liquid slides down the working face on the upstream side of the blade 622 in terms of the movement direction of the wiped surface 620. A wiping process using the wiper blade is desirable for removing (wiping) the liquid that has relatively low viscosity and has been applied thinly over a broad range.

In the conveyance drum 600 employed in the drum conveyance method shown in FIG. 25, a holding member (gripper) 608, which holds the leading end portion of the recording medium 604, is arranged and the holding member 608 has a structure of which a portion projects beyond the conveyance drum surface 600A. Therefore, in order to avoid collisions between the holding member 608 and the application roller 606 and the blade (not shown) for cleaning the conveyance drum surface 600A which are disposed adjacently to the conveyance drum surface 600A, it is necessary to separate the application roller 606 and the blade from the conveyance drum surface 600A when the holding member 608 passes.

On the other hand, when the blade is withdrawn from the conveyance drum surface 600A, the portion of liquid (liquid pool) that has been wiped by the blade immediately beforehand is left at a position on the conveyance drum surface 600A that passes by the wiping region of the blade while the blade that is disposed adjacently to the holding member 608 is being withdrawn. The liquid accumulates in the liquid pool while the cleaning of the conveyance drum surface 600A is repeated, and there is a problem in that eventually, trickling of the liquid occurs.

SUMMARY OF THE INVENTION

The present invention has been contrived in view of these circumstances, an object thereof being to provide a cleaning device, a liquid application device and an image forming apparatus whereby a desirable cleaning process is achieved and liquid wiping residue caused by obstacles, such as the holding member, or the like, which is arranged on the medium holding surface, is prevented.

In order to attain the aforementioned object, the present invention is directed to a cleaning device, comprising: a wiper blade which is arranged along an axial direction of a pressure drum holding and conveying a medium on which liquid is applied, the pressure drum holding the medium on a pressure drum circumferential surface of the pressure drum and conveying the medium in a prescribed medium conveyance direction, the wiper blade wiping and removing the liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction; a movement device which moves the wiper blade so as to separate the wiper blade from the pressure drum circumferential surface when a gripping member arranged on the pressure drum to hold an end portion of the medium passes a wiping process position of the wiper blade; and a liquid pool removal device which removes at least a portion of the liquid in a liquid pool formed by the liquid that has been wiped by the wiper blade immediately before the wiper blade is separated from the pressure drum circumferential surface and that has not slid completely down the wiper blade face.

According to the present invention, the liquid pool, which is formed on the pressure drum circumferential surface due to the wiper blade being separated from the pressure drum circumferential surface when the gripping member which grips the end portion of the medium arranged on the pressure drum passes the wiping process position of the wiper blade, is removed, and accumulation of the liquid in the liquid pool is prevented.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

First Embodiment

Description of Method for Cleaning Circumferential Surface of Pressure Drum

Figure 1:
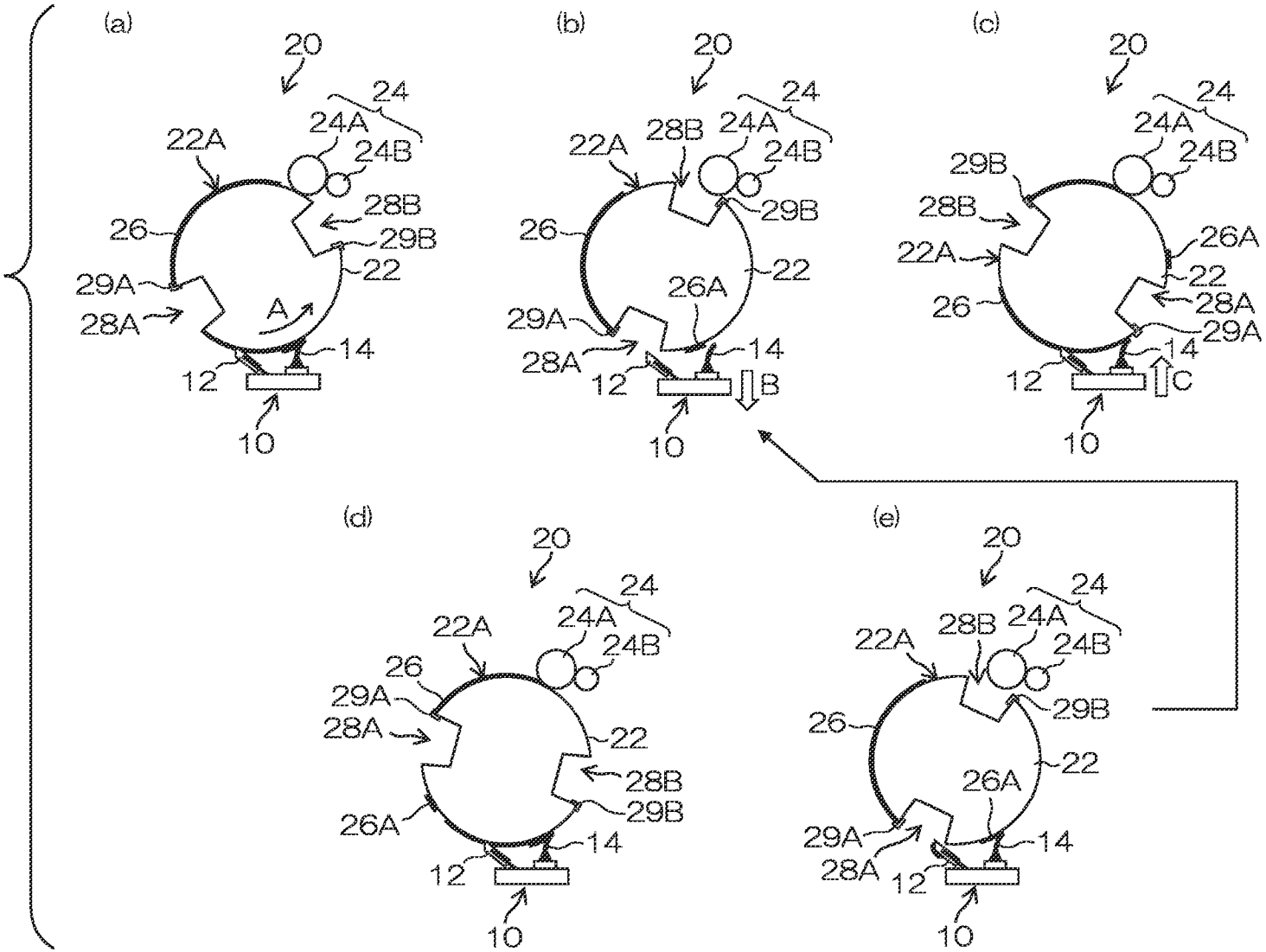
FIG. 1 is a conceptual diagram showing a cleaning method according to a first embodiment of the present invention.

FIG. 1 is an illustrative diagram showing schematic views of respective steps (a) to (e) of a cleaning process for a pressure drum that uses a cleaning device according to an embodiment of the present invention. The cleaning device 10 shown in FIG. 1 removes liquid adhering to a circumferential surface 22A of a pressure drum 22 arranged in a liquid application device 20. The cleaning device 10 has a doctor blade 12 and a wiper blade 14 as devices for removing the liquid from the pressure drum circumferential surface 22A. A structure is adopted in which the doctor blade 12 is disposed on the upstream side and the wiper blade 14 is disposed on the downstream side, in terms of the movement direction of the medium held on the medium holding surface (pressure drum circumferential surface 22A).

Figure 26A:
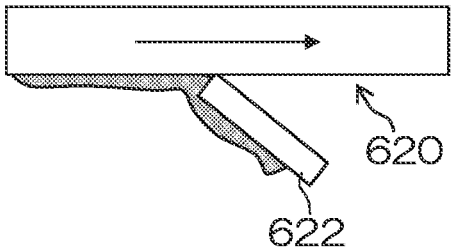
FIG. 26A RELATED ART
FIGS. 26A and 26B are illustrative diagrams of a wiping process by a doctor blade and a wiper blade in the related art.

In the present specification, the "doctor blade" is the blade disposed in such a manner that an obtuse angle is formed between a doctor blade face, which is the face of the blade on the upstream side in terms of the movement direction of the wiped surface (the medium conveyance direction), and the tangential direction to the wiped surface on the upstream side from the blade in terms of the movement direction of the wiped surface at the point of contact (or proximation) between the wiped surface and the edge of the blade (see FIG. 26A), and the blade is disposed at an orientation against the movement direction of the wiped surface. When the doctor blade is in an abutted state with respect to the wiped surface, a prescribed clearance is allowed between the edge of the blade and the wiped surface.

Figure 26B:
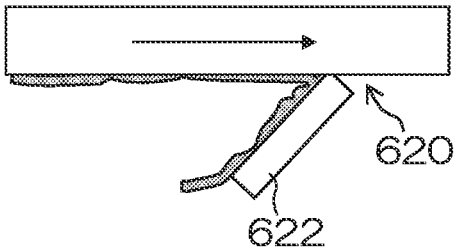
FIG. 26B RELATED ART

On the other hand, the "wiper blade" is the blade disposed in such a manner that an acute angle is formed between a wiper blade face, which is the face of the blade on the upstream side in terms of the movement direction of the wiped surface, and the tangential direction to the wiped surface on upstream side from the blade in terms of the movement direction of the wiped surface at the point of contact between the wiped surface and the edge of the blade (see FIG. 26B), and the blade is abutted in an orientation along the movement direction of the wiped surface. When the wiper blade is in an abutted state with respect to the wiped surface, the edge of the wiper blade makes contact with the wiped surface to an extent whereby the edge portion of the wiper blade elastically deforms.

The doctor blade 12 is disposed along the axial direction of the pressure drum 22 (which direction is perpendicular to the sheet of the drawings in FIG. 1), and the length of the doctor blade 12 in this direction corresponds to the dimension of the pressure drum 22 in the axial direction. Similarly, the wiper blade 14 is disposed along the axial direction of the pressure drum 22, and the length of the wiper blade 14 in this direction corresponds to the dimension of the pressure drum 22 in the axial direction. Each of the doctor blade 12 and the wiper blade 14 can be disposed at an oblique direction with respect to the axial direction of the pressure drum 22, in such a manner that the angle formed between the axial direction of the pressure drum 22 and the lengthwise direction of the doctor blade 12 or the wiper blade 14 is greater than 0° and less than 90°. Moreover, it is also possible to arrange, in the axial direction of the pressure drum 22, a plurality of short doctor blades 12 and wiper blades 14 which are shorter than the axial direction dimension of the pressure drum 22, so as to correspond to the axial direction dimension of the pressure drum 22.

The doctor blade 12 and the wiper blade 14 are arranged movably by means of a movement mechanism (not shown), in such a manner that the doctor blade 12 and the wiper blade 14 can be unitedly separated from the pressure drum circumferential surface 22A.

The liquid application device 20 includes: the pressure drum 22, which conveys the medium (not shown) by rotating in a state of holding the medium on the pressure drum circumferential surface 22A; and a liquid application unit 24, which applies liquid to the medium held on the pressure drum 22. The liquid application unit 24 has an application roller 24A and a supply roller 24B, which supplies the liquid to the application roller 24A.

The application roller 24A has a dimension in the axial direction (lengthwise direction) slightly greater than the width of the medium (the dimension in the direction substantially perpendicular to the movement direction of the medium), and the liquid is applied to the whole surface of the medium by moving the application roller 24A and the medium relatively to each other just once. In this composition, excess liquid adheres to the pressure drum circumferential surface 22A (in the portion surrounding the medium).

The pressure drum 22 has gripper sections 28A and 28B arranged on the circumferential surface 22A along the axial direction of the pressure drum 22. In the gripper sections 28A and 28B, grippers 29A and 29B are arranged, and each of the grippers 29A and 29B has a hook part, which grips the leading end portion of the medium (not shown) and has a structure projecting beyond the pressure drum circumferential surface 22A. FIG. 1 shows a mode where the gripper sections 28A and 28B are arranged in two locations having a symmetrical relationship with respect to the axis of the pressure drum 22 (positions which divide the whole circumference of the pressure drum 22 into two equal parts).

FIG. 1 shows a state (a) in a step of removing the liquid adhering to the pressure drum circumferential surface 22A on a region from the gripper section 28B to the gripper section 28A (the first wiping step). In the state (a) shown in FIG. 1, when the pressure drum 22 is rotated in a prescribed direction of rotation (the counter-clockwise direction (indicated with the arrow A) in FIG. 1) with the doctor blade 12 and the wiper blade 14 in the abutted state with respect to the pressure drum circumferential surface 22A, then firstly, the liquid 26 adhering to the pressure drum circumferential surface 22A is wiped and removed by the doctor blade 12.

The liquid 26 that has passed through the clearance between the doctor blade 12 and the pressure drum circumferential surface 22A and has remained on the pressure drum circumferential surface 22A is wiped and removed by the wiper blade 14. The wiping process with the doctor blade 12 is suited to removing liquid of relatively high viscosity and a liquid layer of a certainly thick dimension, but does not readily remove completely liquid of low viscosity, such as treatment liquid, or a liquid layer of thin dimension (e.g., a thickness of approximately 0.1 μm to 10 μm). Since the liquid that has not been removed by the doctor blade 12 interposes between the wiper blade 14 and the pressure drum circumferential surface 22A in the latter stage, then it is possible to prevent the abrasion of the wiper blade 14 and occurrence of abrasive marks in the pressure drum circumferential surface 22A.

The liquid removed by the wiper blade 14 slides down the side face of the wiper blade 14 (the upstream side face in the medium conveyance direction), is temporarily collected in a liquid collecting section 34B (not shown in FIG. 1, and shown in FIG. 3), and is then discharged to the exterior of the apparatus.

FIG. 1 then shows a state (b) where the gripper section 28A is passing the processing region of the doctor blade 12. In the state (b) shown in FIG. 1, in order to avoid collisions between the gripper 29A and the doctor blade 12 and the wiper blade 14, the doctor blade 12 and the wiper blade 14 are unitedly separated from the pressure drum circumferential surface 22A (separating step) in a direction indicated with an arrow B in FIG. 1 (the separation direction).

While the doctor blade 12 and the wiper blade 14 are being separated from the pressure drum circumferential surface 22A, a liquid pool 26A is formed by a portion of the liquid adhering to the vicinity of the gripper section 28A on the downstream side thereof in terms of the medium conveyance direction, the portion passing through the clearance between the doctor blade 12 and the pressure drum circumferential surface 22A and having not slid down completely off the side face of the wiper blade 14.

FIG. 1 then shows a state (c) immediately after the gripper section 28A has passed the processing region of the wiper blade 14. When the gripper section 28A has passed the processing region of the wiper blade 14, the doctor blade 12 and the wiper blade 14 are unitedly moved to be abutted against the pressure drum circumferential surface 22A (abutting step) in a direction indicated with an arrow C in FIG. 1 (the abutment direction), and a wiping process from the gripper section 28A up to the gripper section 28B is carried out (second wiping step). The liquid pool 26A between the gripper section 28A and the gripper section 28B is left and moved in an unaltered state on the pressure drum circumferential surface 22A.

The distance between the gripper section 28A and the gripper section 28B is greater than the length of the medium used in the medium conveyance direction, and the liquid pool 26A (the position where the wiper blade 14 is separated) is positioned behind the trailing end of the medium, so that the liquid pool 26A never makes contact with the medium. Moreover, when the liquid pool 26A arrives at the application processing region of the application roller 24A, the application roller 24A is separated from the pressure drum 22, in such a manner that the treatment liquid is not applied over the liquid pool 26A.

FIG. 1 then shows a state (d) where the pressure drum 22 has further rotated and the wiping process is being carried out on the region from the gripper section 28B to the gripper section 28A (a state during a second implementation of the first wiping step). When the liquid pool 26A reaches the wiping process position of the doctor blade 12 as the pressure drum 22 further rotates, a portion of the liquid in the liquid pool 26A is removed by the doctor blade 12 (liquid pool removal step).

FIG. 1 then shows a state (e) immediately after the portion of the liquid of the liquid pool 26A has been removed by the doctor blade 12 (immediately after completion of the liquid pool removal step).

According to the cleaning method for the pressure drum circumferential surface 22A in the present embodiment, the doctor blade 12 and the wiper blade 14 are disposed on the upstream side and the downstream side with respect to each other in terms of the medium conveyance direction, and both of these blades are used in combination, then it is possible to prevent dripping of the liquid due to accumulation of the liquid in the liquid pool 26A formed on the pressure drum circumferential surface 22A, and also to prevent the abrasion of the wiper blade 14 and occurrence of abrasive marks in the pressure drum circumferential surface 22A resulting from dry wiping by the wiper blade 14, because the liquid left unwiped by the doctor blade 12 performs an action in the wiping by the wiper blade 14.

Since the wiper blade 14 is pressed against the pressure drum circumferential surface 22A to an extent whereby the edge portion of the wiper blade 14 elastically deforms, then minute undulations in the pressure drum circumferential surface 22A and minute undulations in the edge of the wiper blade 14 can be filled by the elastic deformation of the wiper blade 14, and the liquid adhering to the pressure drum circumferential surface 22A does not pass between the pressure drum circumferential surface 22A and the wiper blade 14, but rather is reliably removed.

On the other hand, the doctor blade 12 is abutted toward the pressure drum circumferential surface 22A to an extent whereby the doctor blade 12 does not deform or the prescribed clearance is left between the edge of the doctor blade 12 and the pressure drum circumferential surface 22A. Thereby, abrasion of the doctor blade 12 is prevented, and moreover, since a portion of the liquid adhering to the pressure drum circumferential surface 22A passes between the doctor blade 12 and the pressure drum circumferential surface 22A, then the wiper blade 14 performs a wet wiping action. Thus, abrasion of the wiper blade 14 is suppressed, and no abrasive mark is liable to occur in the pressure drum circumferential surface 22A.

The liquid pool 26A remaining when the wiper blade 14 is separated from the pressure drum circumferential surface 22A moves with the travel of the pressure drum circumferential surface 22A, and upon reaching the position of the doctor blade 12, the liquid pool 26A is scraped away by making contact with the doctor blade 12, and accumulation of the liquid pool 26A is prevented. The angle formed between the doctor blade 12 and the pressure drum circumferential surface 22A (the angle β in FIG. 4) is determined in such a manner that the contacted liquid readily slides down the doctor blade 12. Splashing of the liquid that occurs when the doctor blade 12 passes the trailing edges of the pressure drum circumferential surface 22A (namely, the leading edges of the gripper sections 28A and 28B) is greatly reduced.

Moreover, by arranging the doctor blade 12 in the stage before the wiper blade 14, then even in cases where relatively large foreign matter is adhering to the pressure drum circumferential surface 22A, it is possible to remove this adhering matter by means of the doctor blade 12 before arriving at the position of the wiper blade 14, and therefore the occurrence of critical damage to the wiper blade 14 is prevented.

Furthermore, by moving the doctor blade 12 and the wiper blade 14 unitedly, complex movement mechanisms and control procedures become unnecessary and improvement in maintenance properties is expected.

<Description of Structure of Cleaning Device>

Next, the structure of the cleaning device 10 shown in FIG. 1 is described in detail.

Figure 2:
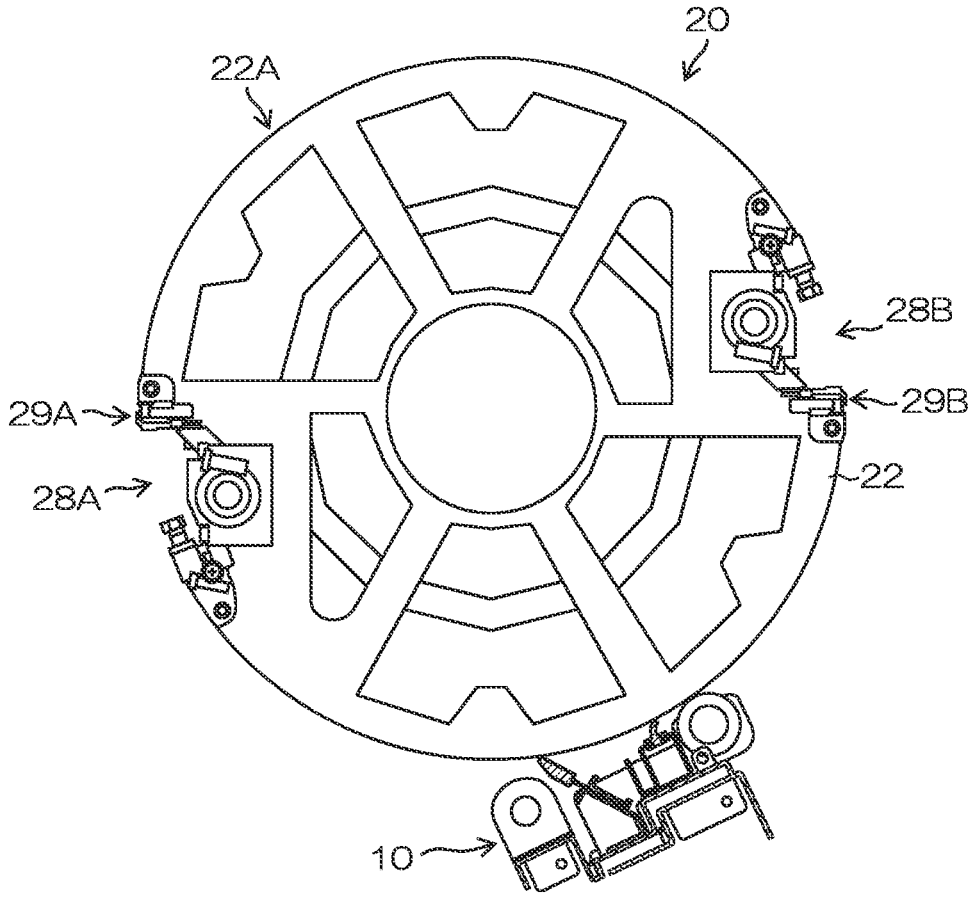
FIG. 2 is a schematic drawing showing the general composition of a cleaning device according to the first embodiment of the present invention.
Figure 3:
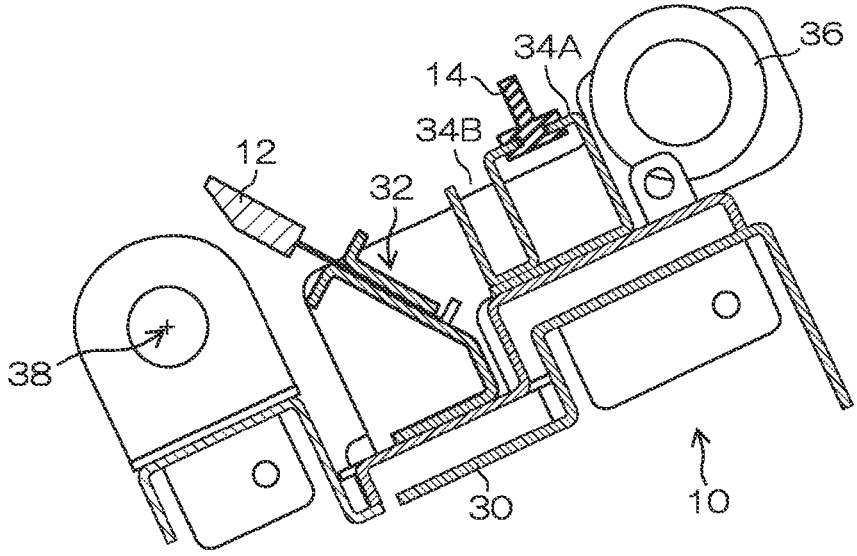
FIG. 3 is an enlarged diagram of the cleaning device shown in FIG. 2.

FIG. 2 is a schematic drawing showing the general composition of the cleaning device 10, depicting the state where the doctor blade 12 and the wiper blade 14 is abutted to the pressure drum circumferential surface 22A. FIG. 3 is a diagram showing an extracted enlarged view of the cleaning device 10 shown in FIG. 2. In FIGS. 2 and 3, the parts which are the same as or similar to those in FIG. 1 are denoted with the same reference numerals and further explanation thereof is omitted here.

The cleaning device 10 shown in FIG. 3 has a structure in which the doctor blade 12 and the wiper blade 14 are fixed on a frame 30, and the doctor blade 12 and the wiper blade 14 are unitedly moved by moving the frame 30.

Attached to the frame 30 are: a doctor fixing member 32, to which the doctor blade 12 is fixed; a wiper fixing member 34A, to which the wiper blade 14 is fixed; and a liquid collecting section 34B, in which the liquid removed from the pressure drum circumferential surface 22A by the wiper blade 14 is collected.

A cam follower 36 is arranged on the downstream side end portion of the frame 30 in terms of the medium conveyance direction, and the upstream side end portion of the frame 30 in terms of the medium conveyance direction is held with a rotary link 38. The frame 30 is impelled toward the pressure drum 22 at all times by an impelling member such as a tensile spring (not shown).

Each of the doctor blade 12 and the wiper blade 14 is made of a material having greater hydrophilic properties than the material used for the pressure drum circumferential surface 22A (if a jacket is arranged on the pressure drum circumferential surface 22A, the material used for the jacket surface).

It is desirable to use natural rubber, nitrile rubber, urethane rubber, fluoride rubber, silicone rubber, or the like, as the material for the doctor blade 12 and the wiper blade 14. Furthermore, a metal material such as SUS304, SPCC, or the like, is desirable for use as the material of the circumferential surface (or the jacket surface) 22A of the pressure drum 22.

<Description of Doctor Blade and Wiper Blade Separating Operation>

Figure 4:
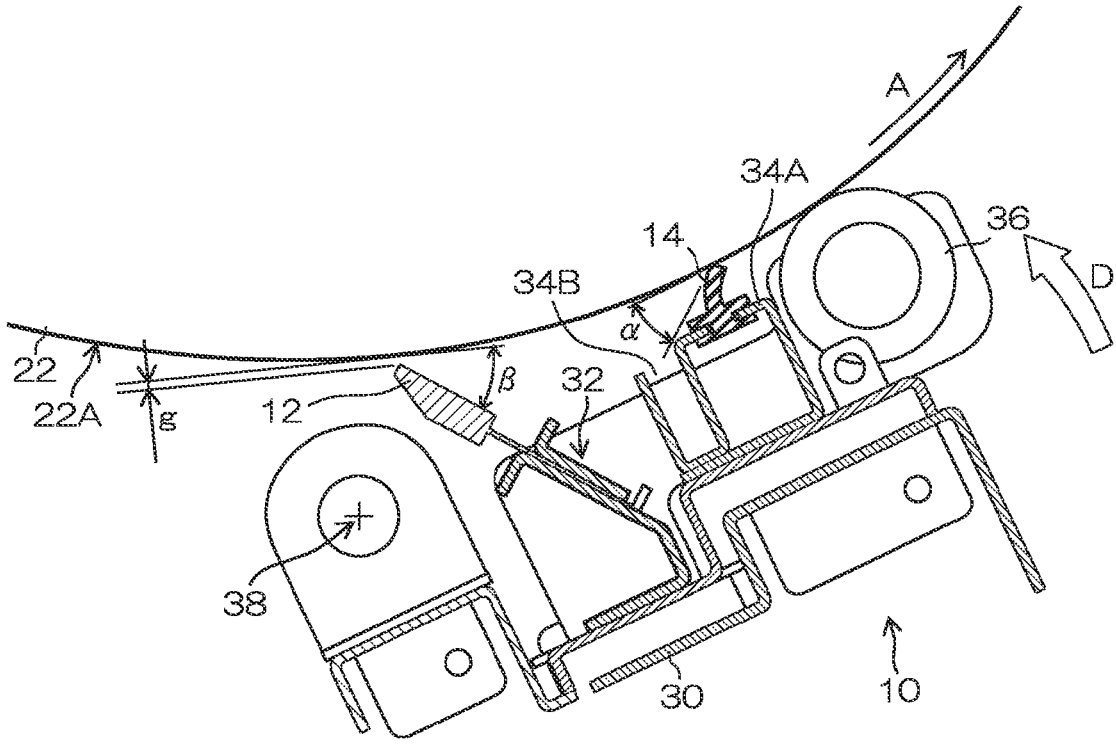
FIG. 4 is a diagram showing a state during a wiping process of the cleaning device shown in FIG. 3.

FIG. 4 is a partial enlarged view of FIG. 2, and shows a state during the cleaning process by the cleaning device 10. As shown in FIG. 4, the impelling force acts in the direction indicated with an arrow D in FIG. 4 during the cleaning process so that the wiper blade 14 and the cam follower 36 are in contact with the pressure drum circumferential surface 22A, and the doctor blade 12 is proximate to the pressure drum circumferential surface 22A.

The cleaning device 10 is disposed in such a manner that the contact angle α of the wiper blade 14 is not smaller than 40° and not larger than 60°, the contact angle β of the doctor blade 12 is not smaller than 20° and not larger than 40°, and the clearance g between the doctor blade 12 and the pressure drum circumferential surface 22A (the minimum distance between the doctor blade 12 and the pressure drum circumferential surface 22A) is not larger than 0.2 mm. The clearance of approximately 0.05 mm can be set between the doctor blade 12 and the pressure drum circumferential surface 22A. Here, the contact angle α of the wiper blade 14 is the angle formed between the tangent to the pressure drum circumferential surface 22A at the point of contact between the wiper blade 14 and the pressure drum circumferential surface 22A when the wiper blade 14 is in a state of abutment against the pressure drum circumferential surface 22A, and the face of the wiper blade 14 on the upstream side in terms of the medium conveyance direction. The contact angle β of the doctor blade 12 is the angle formed between the tangent to the pressure drum circumferential surface 22A at the intersection of the pressure drum circumferential surface 22A and an extended plane obtained by extending the face of the doctor blade 12 on the downstream side in terms of the medium conveyance direction toward the pressure drum circumferential surface 22A, and the extended plane.

Figure 5:
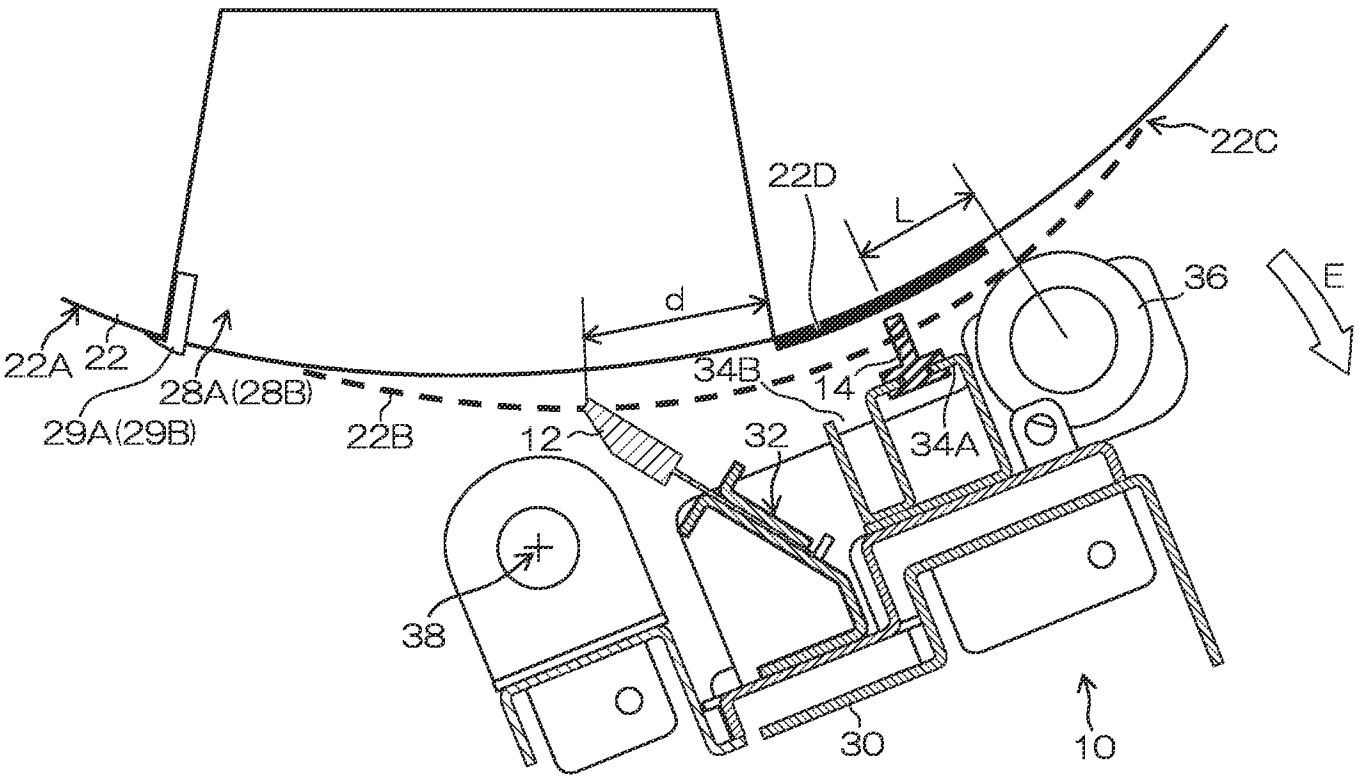
FIG. 5 is a diagram showing a state during separation of the cleaning device shown in FIG. 3.

FIG. 5 is an illustrative diagram showing a state where the doctor blade 12, the wiper blade 14 and the cam follower 36 have been separated from the pressure drum circumferential surface 22A when the gripper section 28A or 28B passes the processing region of the cleaning device 10.

When the cam follower 36 rides up on a cam section 22B (depicted with a dashed line) arranged on the pressure drum 22, the doctor blade 12 and the wiper blade 14 are unitedly moved about the rotary link 38 in the direction indicated with an arrow E in FIG. 5. The timing of the separation of the doctor blade 12 and the wiper blade 14 from the pressure drum circumferential surface 22A is before the wiper blade 14 reaches the gripper section 28A (or 28B), and after the doctor blade 12 reaches the gripper section 28A (or 28B).

In other words, the doctor blade 12, the wiper blade 14 and the cam follower 36 are disposed in such a manner that, when the cam follower 36 reaches a leading part 22C of the cam section 22B (when the doctor blade 12 and the wiper blade 14 start the separating operation), the doctor blade 12 is positioned at the gripper section 28A (or 28B), and the wiper blade 14 is positioned before the gripper section 28A (or 28B).

It is desirable that, at the separation start timing, the distance d between the position of the doctor blade 12 and the leading end of the gripper section 28A (or 28B) is not smaller than 10 mm, and moreover, the distance L between the position of the wiper blade 14 and the trailing end position of the medium of maximum size is not smaller than 10 mm. It is made possible to remove the accumulated liquid from the liquid pool 26A by means of the doctor blade 12, by distancing the separation position of the doctor blade 12 by 10 mm or greater toward the gripper section 28A (or 28B) from the trailing end of the semi-circumferential surface of the pressure drum 22 (namely, the downstream end of the gripper section 28A (or 28B) in the medium conveyance direction). Furthermore, soiling of the trailing end portion of the medium by the liquid pool 26A during the separation is prevented by distancing the separation position of the wiper blade 14 by 10 mm or greater from the trailing end position of the medium of maximum size.

It is desirable that a portion 22D of the pressure drum circumferential surface 22A which does not make contact with the wiper blade 14 is subjected to a liquid repelling treatment (liquid repelling coating). A position on the downstream side of the gripper section 28A (or 28B) in terms of the medium conveyance direction, where the liquid pool 26A is liable to occur, is desirably provided with the liquid repelling treatment, which increases the liquid repelling properties in respect of the liquid applied by the liquid application unit 24, in comparison with the doctor blade 12 and the wiper blade 14. Here, a "liquid repelling" means a state where the contact angle of the application liquid with respect to the pressure drum circumferential surface 22A is not smaller than 60°. By carrying out the liquid repelling treatment, the removal of the liquid pool 26A by the doctor blade 12 is improved, the transfer of the liquid from the pressure drum circumferential surface 22A to the doctor blade 12 and the wiper blade 14 is made smoother, and the liquid adhering to the doctor blade 12 and the wiper blade 14 becomes less liable to separate, thus preventing splashing of the liquid and reattachment of the liquid to the pressure drum circumferential surface 22A. Moreover, the amount of surplus treatment liquid is reduced and the load on the cleaning is reduced.

Furthermore, in order to prevent abrasion of the wiper blade 14 and abrasive marks in the pressure drum circumferential surface 22A, a desirable mode is one where the wiper blade 14 and the portion where the wiping process is carried out by the wiper blade 14 are wetted.

Figure 6:
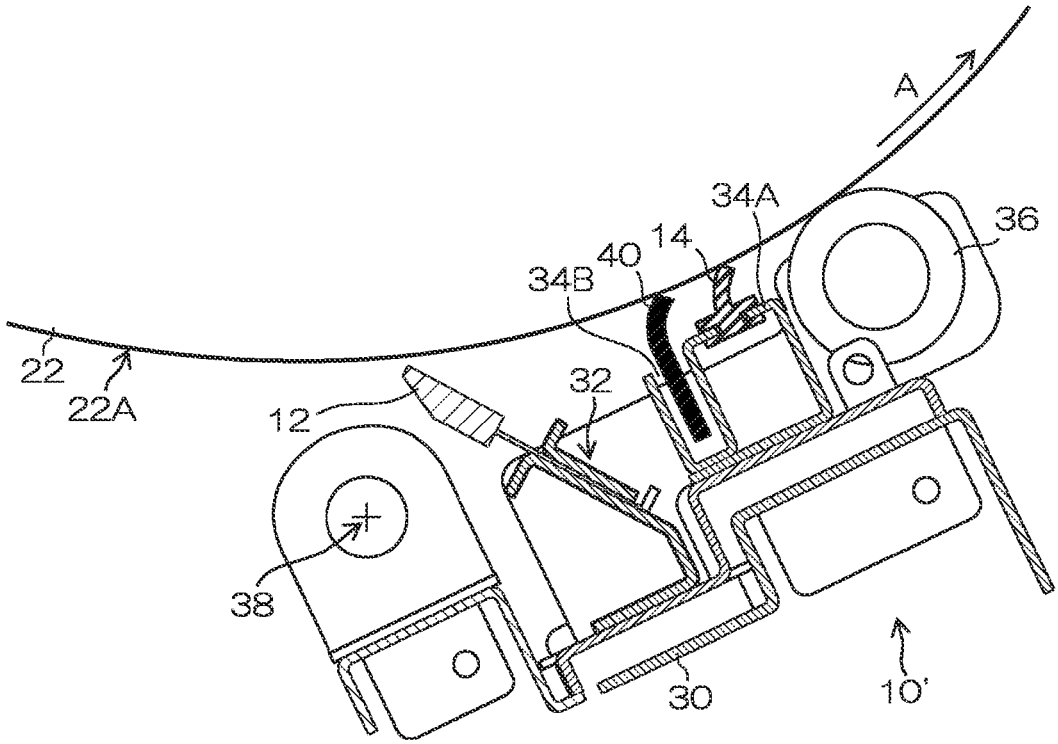
FIG. 6 is a diagram showing a modification of the cleaning device shown in FIG. 3.
Figure 7:
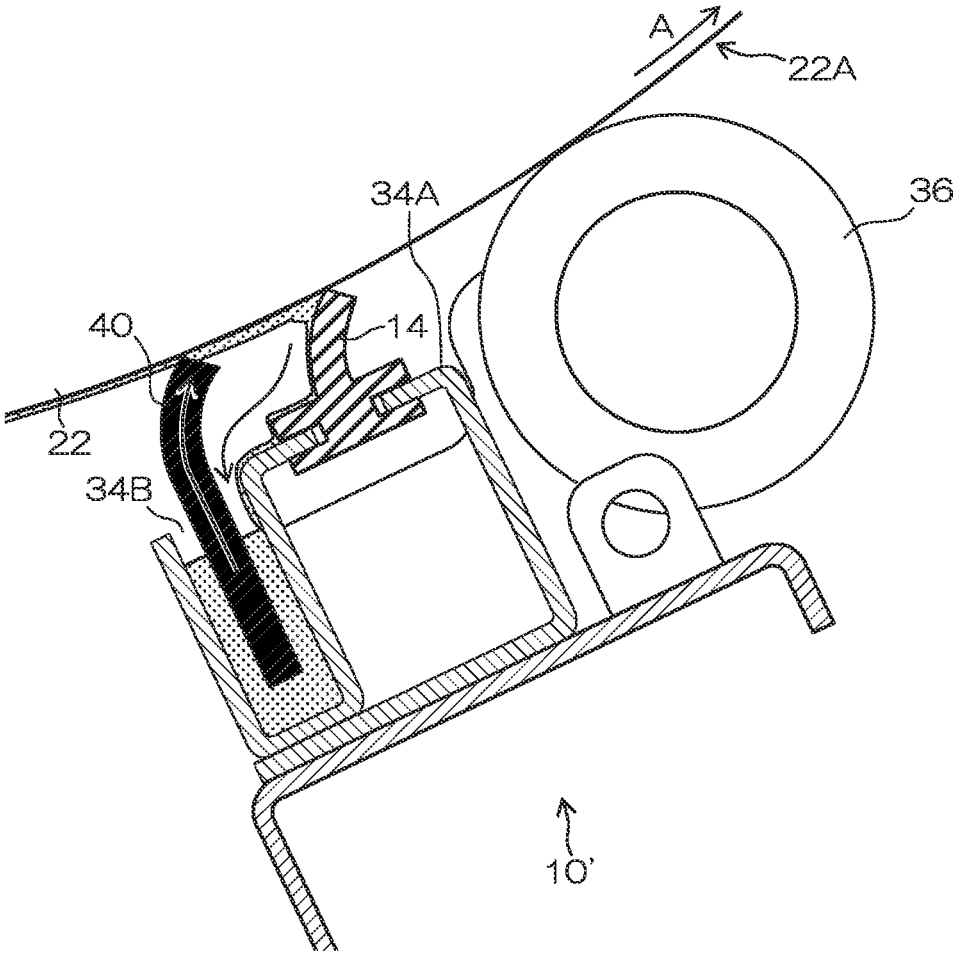
FIG. 7 is a diagram for describing the cleaning device shown in FIG. 6.

A cleaning device 10' shown in FIG. 6 includes a liquid application member 40, which applies the liquid having been collected in the liquid collecting section 34B to the pressure drum circumferential surface 22A. For the liquid application member 40, it is desirable to use a sponge (porous member) which sucks in the liquid collected in the liquid collecting unit 34B by capillary action (see FIG. 7). In the mode shown in FIGS. 6 and 7, the wiper blade 14 and the pressure drum circumferential surface 22A are wetted by reusing the liquid that has been removed from the pressure drum circumferential surface 22A, and therefore special liquid for wetting is not required. Furthermore, there is no need to replenish the liquid used for wetting, and increase in the amount of waste liquid can also be suppressed.

Figure 8:
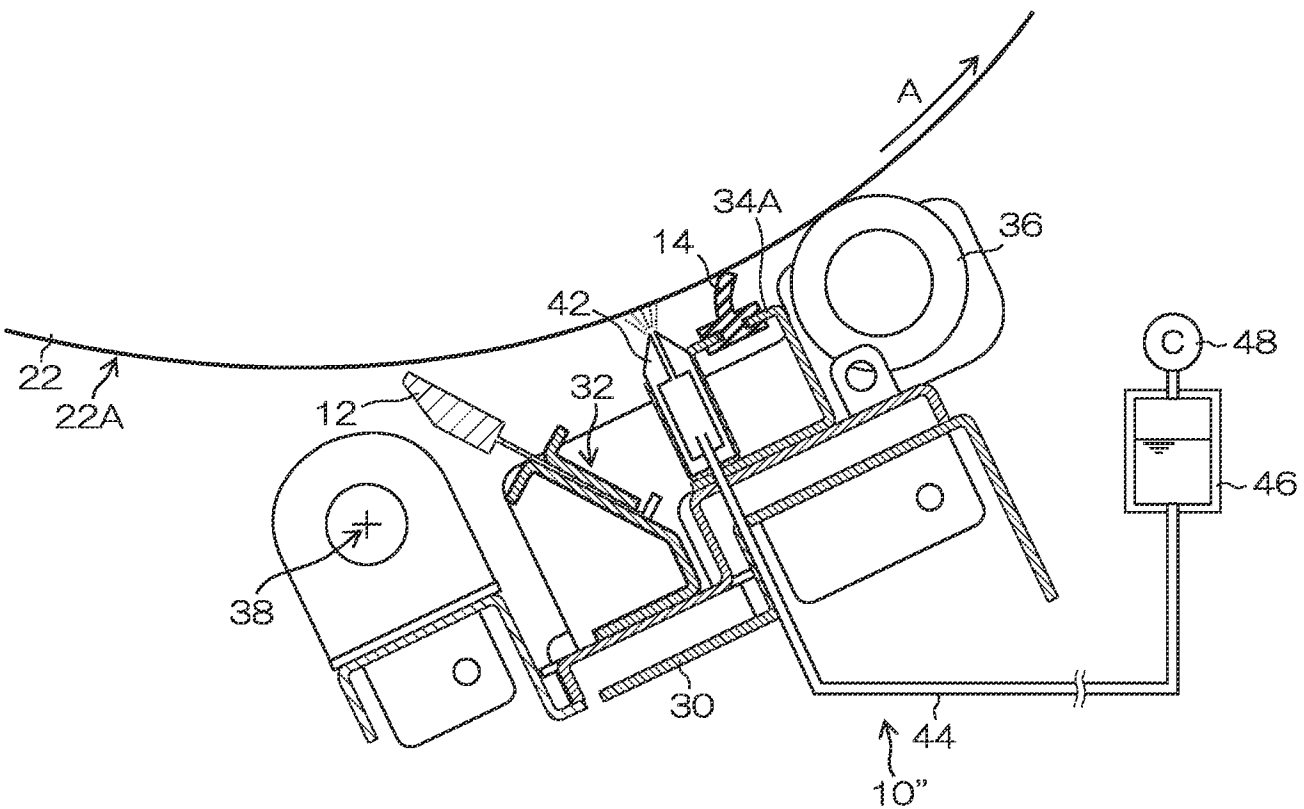
FIG. 8 is a schematic drawing of a cleaning device according to a modification of the first embodiment.

A further mode of a device for wetting the wiper blade 14 and the pressure drum circumferential surface 22A is one having a water supply spray 42, as in a cleaning device 10" shown in FIG. 8. The cleaning device 10" shown in FIG. 8 includes the water supply spray 42 for carrying out a wetting process onto the pressure drum circumferential surface 22A by a spray method, and the water supply spray 42 is arranged on the upstream side of the wiper blade 14 in terms of the medium conveyance direction.

The water supply spray 42 is connected to a water supply tank 46 through a prescribed tube 44 and carries out the wetting process onto the pressure drum circumferential surface 22A by means of the action of a pressure source (e.g., a pump) 48. The liquid used for the wetting process can be a cleaning liquid having a cleaning function, or it can be pure water or deionized water.

According to the mode shown in FIG. 8, it is possible to obtain even better cleaning effects by dissolving the liquid adhering to the pressure drum circumferential surface 22A with the cleaning liquid or water.

Second Embodiment

Next, a method of cleaning a pressure drum using a cleaning device according to a second embodiment of the present invention is described.

<Description of Method for Cleaning Circumferential Surface of Pressure Drum>

Figure 9:
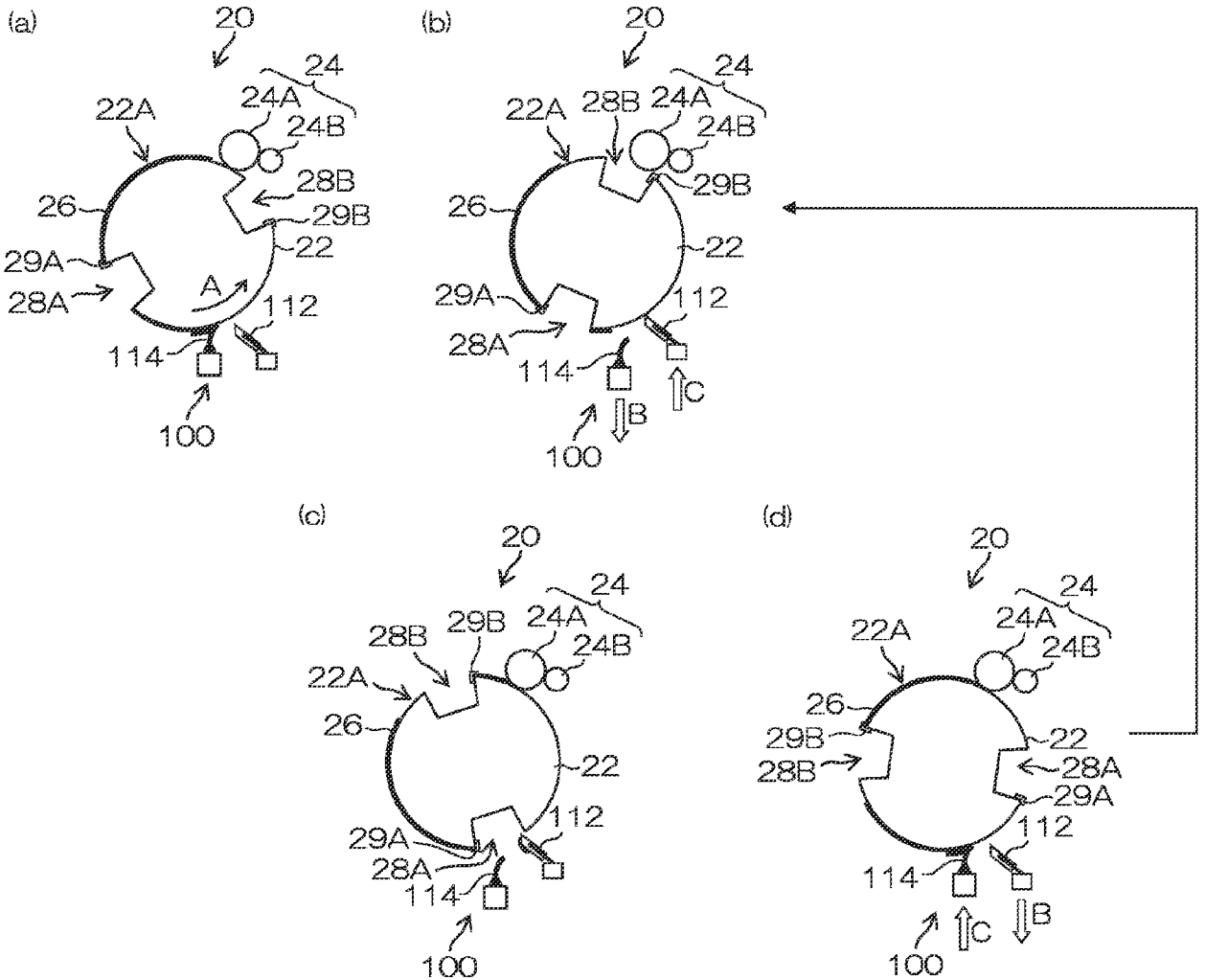
FIG. 9 is a conceptual diagram showing a cleaning method according to a second embodiment of the present invention.

FIG. 9 is an illustrative diagram showing schematic views of respective steps of a cleaning process for the pressure drum circumferential surface 22A using a cleaning device 100. In FIG. 9, parts which are the same as or similar to those in FIG. 1 are denoted with the same reference numerals and further explanation thereof is omitted here.

In the cleaning device 100 shown in FIG. 9, a doctor blade 112 and a wiper blade 114 are disposed on the downstream side and the upstream side with respect to each other in terms of the conveyance direction of the medium (not illustrated) held on the pressure drum circumferential surface 22A. The doctor blade 112 and the wiper blade 114 are composed so that they can be independently and respectively separated from the pressure drum circumferential surface 22A.

In the first wiping step (a) shown in FIG. 9, the wiper blade 114 is abutted against the pressure drum circumferential surface 22A and the liquid adhering to the pressure drum circumferential surface 22A is thereby removed. The liquid removed by the wiper blade 114 slides down the wiper blade 114 and is collected into the liquid collecting section (not shown), and is discharged to the exterior of the apparatus through a discharge flow channel (not shown).

In the separating step (b) shown in FIG. 9, the wiper blade 114 is separated from the pressure drum circumferential surface 22A, and the doctor blade 112, which is arranged behind the wiper blade 114, is abutted toward the pressure drum circumferential surface 22A.

FIG. 9 shows a state (c) where a portion of the liquid pool 26A has been removed by the doctor blade 112 (the removal step). When the portion of the liquid in the liquid pool has been removed by the doctor blade 112 and the gripper section 28A has passed the processing region of the doctor blade 112, then as in a state (d) shown in FIG. 9, the wiper blade 114 is abutted against the pressure drum circumferential surface 22A and the second wiping step is carried out (the wiping of the region from the gripper section 28A to the gripper section 28B). In the second wiping step, the doctor blade 112 is separated from the pressure drum circumferential surface 22A.

In the second wiping step, when the wiper blade 114 arrives at the gripper section 28B, the wiper blade 114 is separated from the pressure drum circumferential surface 22A, thereby avoiding collision between the gripper 29B and the wiper blade 114 (see the state (b) in FIG. 9). In the second separating step, the gripper sections 28A and 28B has been interchanged from the state (b) shown in FIG. 9.

According to the second embodiment, compared to the cleaning device 10 described in the first embodiment, the doctor blade 112 is not disposed in the stage before the wiper blade 114, and thereby liquid is not removed excessively by the doctor blade 112, the wiper blade 114 does not perform dry wiping. Thus, it is possible to prevent abrasion of the wiper blade 114 and the occurrence of abrasive marks in the pressure drum circumferential surface 22A.

Moreover, even if the liquid pool 26A is formed when the wiper blade 114 is separated from the pressure drum circumferential surface 22A, a portion of the liquid of the liquid pool 26A is removed by the doctor blade 112 situated behind the wiper blade 114, and it is thus possible to prevent the occurrence of the liquid pool 26A and soiling of the medium and the interior of the apparatus due to accumulation of the liquid. Furthermore, since the use frequency of the doctor blade 12 is low compared to the first embodiment, it is then possible to prolong the lifespan of the doctor blade 112.

<Description of Structure of Cleaning Device>

Next, the structure of the cleaning device 100 shown in FIG. 9 is described in detail.

Figure 10:
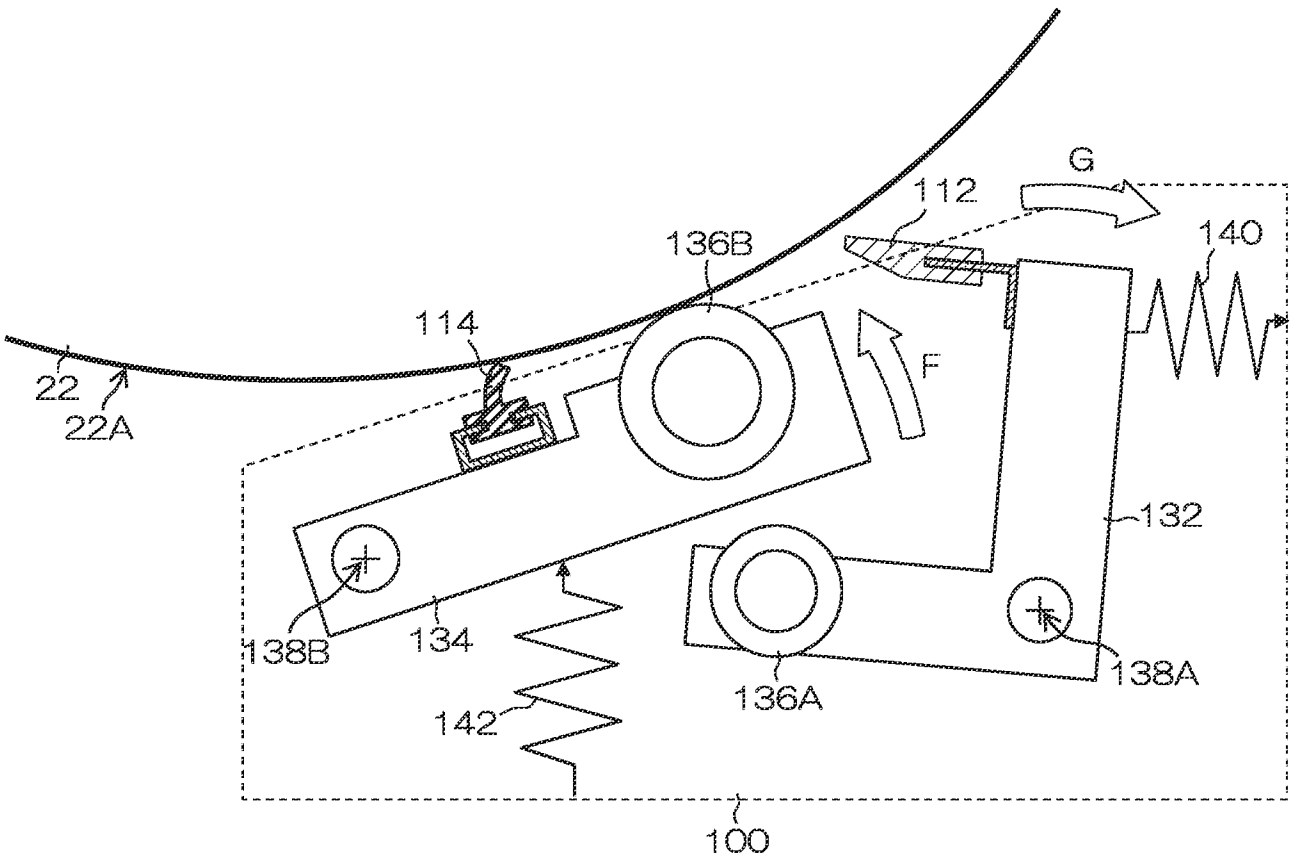
FIG. 10 is a diagram showing a state during a wiping process of the cleaning device according to the second embodiment.
Figure 11:
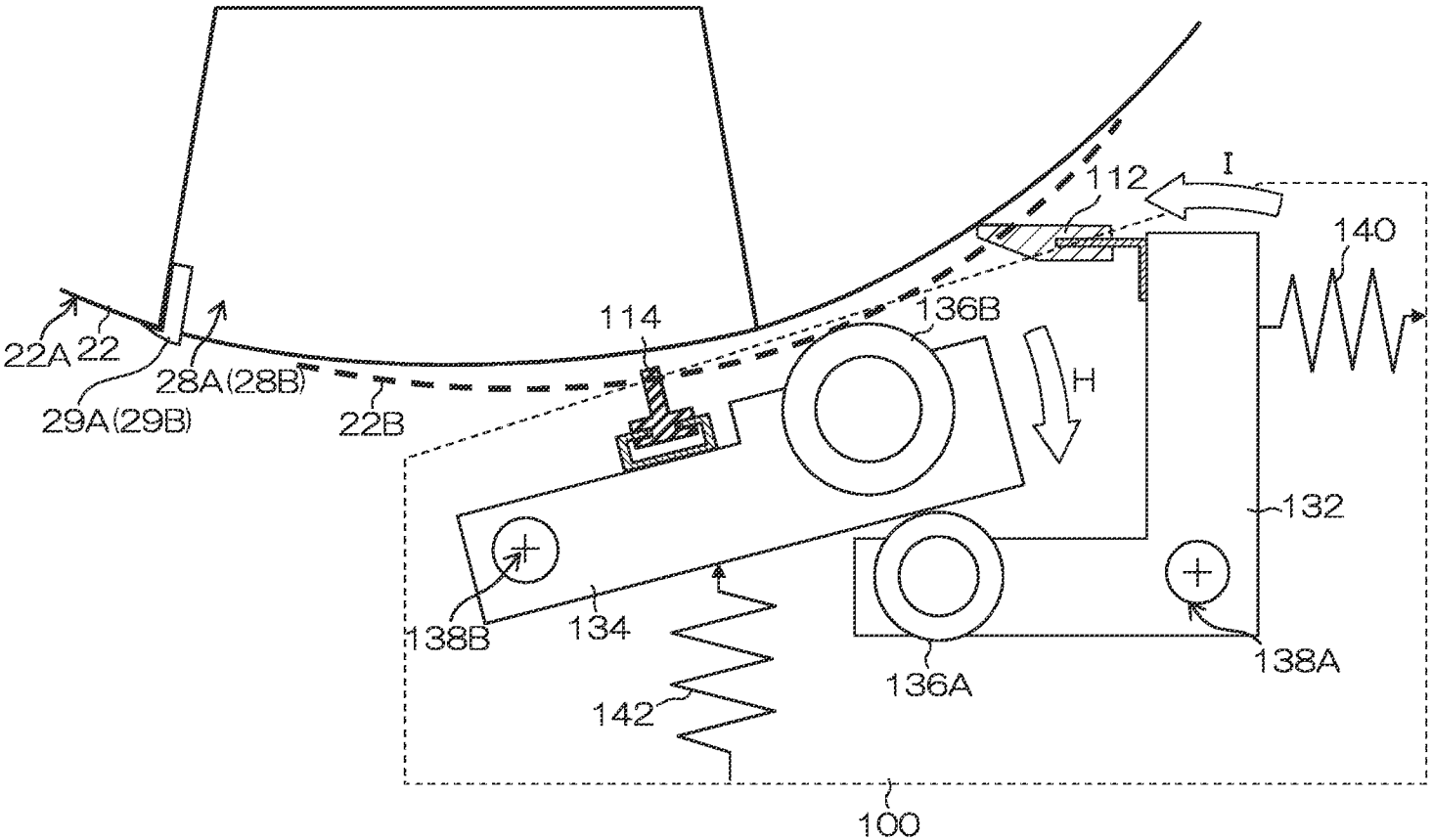
FIG. 11 is a diagram showing a state during separation of the cleaning device shown in FIG. 10.

FIG. 10 is a schematic drawing showing the general composition of the cleaning device 100, depicting the state where the wiper blade 114 has been abutted against the pressure drum circumferential surface 22A and the doctor blade 112 has been separated (the state during the wiping process). FIG. 11 depicts a state where the wiper blade 114 has been separated from the pressure drum circumferential surface 22A and the doctor blade 112 has been abutted toward the pressure drum circumferential surface 22A (the state during removal of the liquid pool).

As shown in FIGS. 10 and 11, the doctor blade 112 is attached on a doctor blade supporting member 132 having substantially an L shape, and a rotary link 138A is arranged in a junction portion between a vertical portion and a horizontal portion which constitute the L shape. The end of the vertical portion supports the doctor blade 112 and is also impelled by a tensile spring 140 in the direction indicated with an arrow G in FIG. 10. A cam follower 136A is arranged in the end of the horizontal portion of the doctor blade supporting member 132. During the wiping process, the doctor blade 112 is impelled in the direction away from the pressure drum circumferential surface 22A, and is thereby separated from the pressure drum circumferential surface 22A.

The wiper blade 114 is attached on a wiper blade supporting member 134. A rotary link 138B is arranged on an end of the wiper blade supporting member 134 on the upstream side in terms of the medium conveyance direction, and a cam follower 136B is arranged on the other end on the upstream side in terms of the medium conveyance direction. The wiper blade supporting member 134 is impelled by a compressive spring 142 in the direction indicated with an arrow F in FIG. 10, in such a manner that the wiper blade 114 and the cam follower 136B are abutted against the pressure drum circumferential surface 22A.

<Description of Separating Operation of Wiper Blade>

In the operation of separating the wiper blade 114 shown in FIG. 11, the cam follower 136B rides up on the cam section 22B depicted with a dashed line in FIG. 11, the wiper blade supporting member 134 is thereby pushed down in the direction indicated with an arrow H, and the wiper blade 114 is thus separated from the pressure drum circumferential surface 22A. Furthermore, when the cam follower 136A is pushed down by the wiper blade supporting member 134, the doctor blade supporting member 132 is turned on the rotary link 138A in the direction indicated with an arrow I in FIG. 11, whereby the doctor blade 112 is placed in proximity with the pressure drum circumferential surface 22A.

It is desirable that the distance between the position on the pressure drum circumferential surface 22A where the wiper blade 14 becomes separated and the trailing end of a medium of maximum size is not smaller than 10 mm. It is also desirable that the distance between the position on the pressure drum circumferential surface 22A with which the doctor blade 112 becomes proximate and the position on the pressure drum circumferential surface 22A where the wiper blade 114 becomes separated is not smaller than 5 mm. Moreover, it is desirable that the distance between the position on the pressure drum circumferential surface 22A where the doctor blade 112 becomes separated from the state of proximity, and the trailing edge of the pressure drum circumferential surface 22A (namely, the leading edge of the gripper section 28A or 28B), is not smaller than 10 mm.

Modified Embodiment

Figure 12:
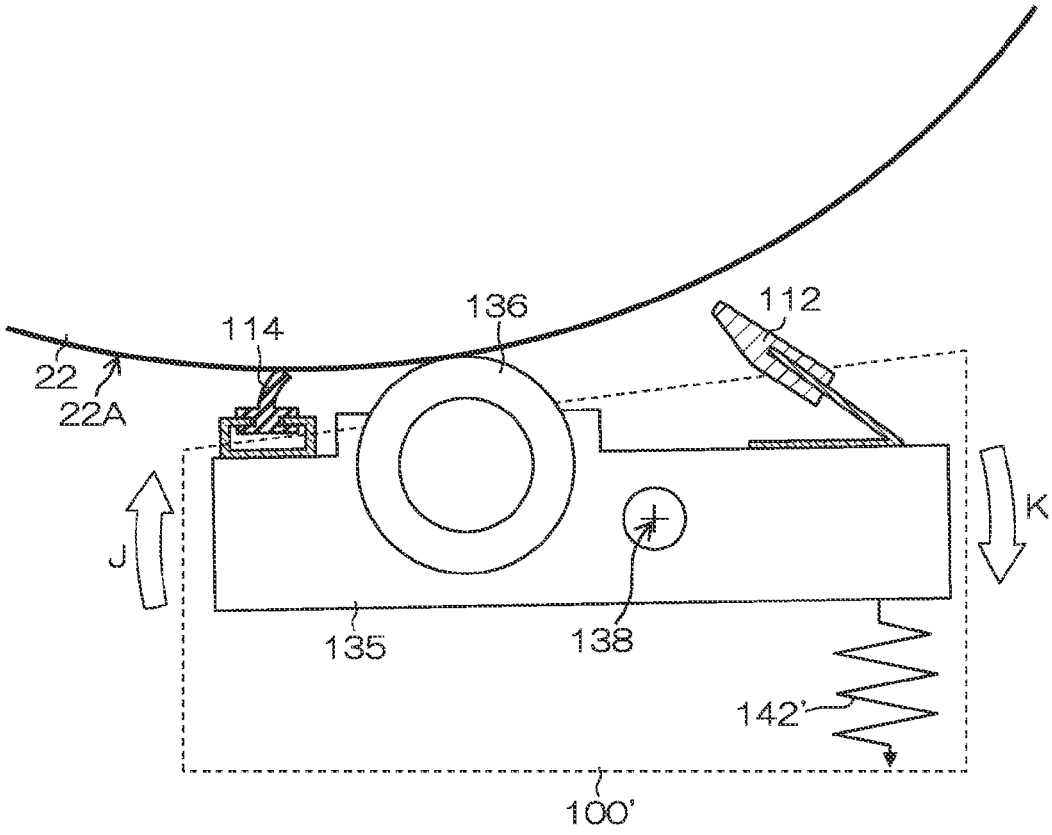
FIG. 12 is a diagram showing a state during a wiping process of a modification of the cleaning device shown in FIG. 10.
Figure 13:
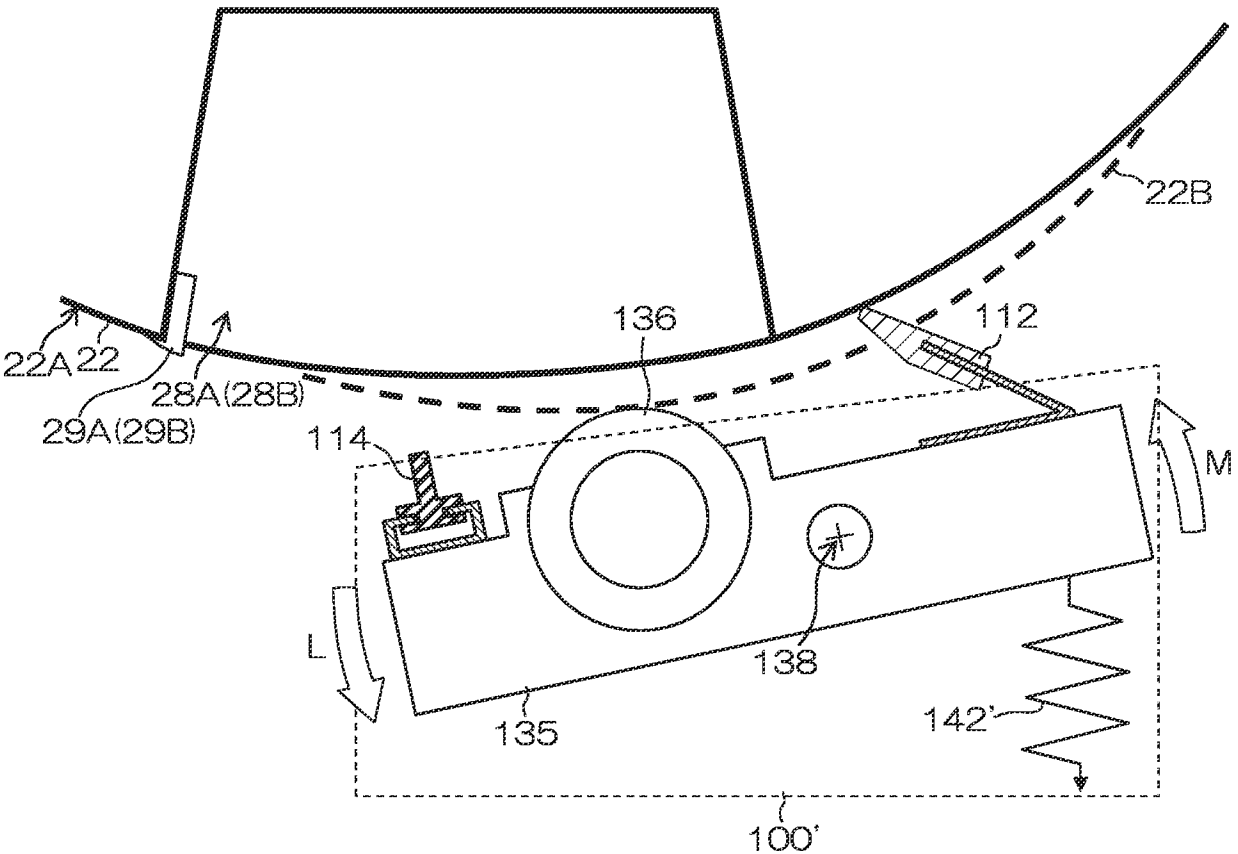
FIG. 13 is a diagram showing a state during separation of the cleaning device shown in FIG. 12.

FIGS. 12 and 13 are general schematic drawings of a cleaning device 100' according to a modification of the second embodiment. FIG. 12 shows a state during the wiping process of the pressure drum circumferential surface 22A by the wiper blade 114 (the state corresponding to FIG. 10), and FIG. 13 shows a state where the wiper blade 114 has been separated from the pressure drum circumferential surface 22A (the state corresponding to FIG. 11) in order to avoid the gripper section 28A (or 28B).

As shown in FIG. 12, the doctor blade 112 is attached on the rear end portion of a frame 135 (the downstream end portion in terms of the medium conveyance direction), and the wiper blade 114 is attached on the front end portion of the frame 135 (the upstream end portion in terms of the medium conveyance direction). A cam follower 136 and a rotary link 138 are disposed in substantially the central portion of the frame 135. Due to a tensile spring 142', a force acts on the rear end portion of the frame 135 in the direction indicated with an arrow K in FIG. 12, and thereby the frame 135 is turned on the rotary link 138 and is impelled in the direction indicated with an arrow J, whereby the wiper blade 114 is brought to contact with the pressure drum circumferential surface 22A.

When the gripper section 28A (or 28B) reaches the wiping process position of the wiper blade 114, the cam follower 136 rides up on the cam section 22B (see FIG. 13), the front end portion of the frame 135 is moved in the direction indicated with the arrow L, and the wiper blade 114 is thereby separated from the pressure drum circumferential surface 22A. Furthermore, the rear end portion of the frame 135 is moved in the direction indicated with the arrow M, and the doctor blade 112 is located in proximity to the pressure drum circumferential surface 22A (the wiping process position).

According to this modified embodiment, it is possible to simplify the supporting structure and the movement structure for the doctor blade 112 and the wiper blade 114 in relation to the pressure drum circumferential surface 22A (the structure for separation from the pressure drum circumferential surface 22A), in comparison with the structure that is provided with separately the doctor blade supporting member 132 for supporting the doctor blade 112 and the wiper blade supporting member 134 for supporting the wiper blade 114.

Third Embodiment

Next, a method of cleaning a pressure drum using a cleaning device according to a third embodiment of the present invention is described.

<Description of Method for Cleaning Circumferential Surface of Pressure Drum>

Figure 14:
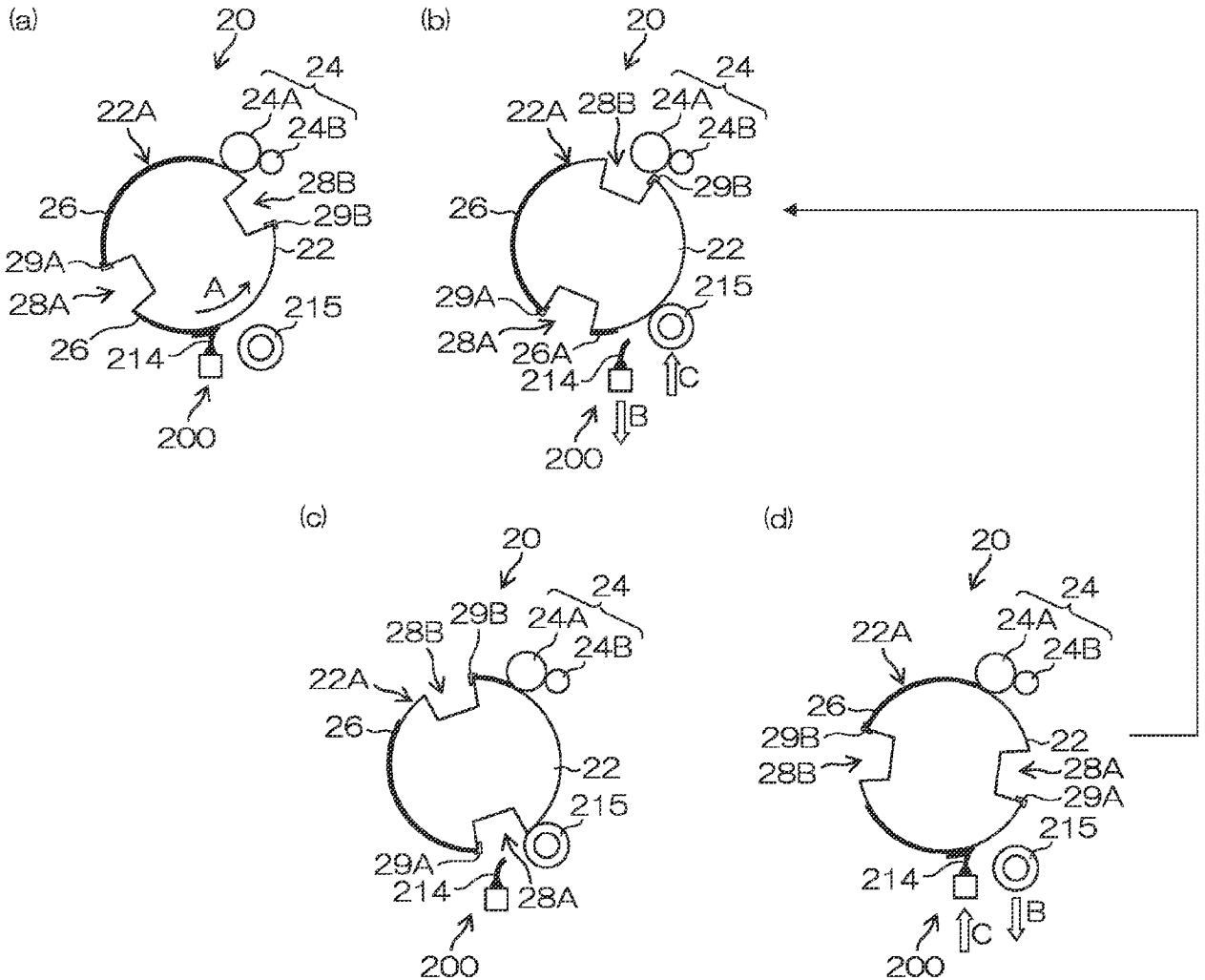
FIG. 14 is a conceptual diagram showing a cleaning method according to a third embodiment of the present invention.

FIG. 14 is an illustrative diagram showing schematic views of respective steps of a cleaning process for the pressure drum circumferential surface 22A using a cleaning device 200. Parts which are the same as or similar to those in the first and second embodiments are denoted with the same reference numerals and further explanation thereof is omitted here.

The cleaning device 200 in the present embodiment is provided with a wiper blade 214, which wipes the pressure drum circumferential surface 22A, and an absorbing roller 215, which is arranged after the wiper blade 214 (on the downstream side of the wiper blade 214 in the medium conveyance direction) and absorbs and removes unwiped liquid that has not been removed by the wiper blade 214. The wiper blade 214 and the absorbing roller 215 are composed in such a manner that they can be independently separated from and abutted to the pressure drum circumferential surface 22A.

FIG. 14 shows a state (a) during the wiping process of the pressure drum circumferential surface 22A by the wiper blade 214, where the wiper blade 214 is abutted against the pressure drum circumferential surface 22A and is removing liquid from the pressure drum circumferential surface 22A. FIG. 14 then shows a state (b) where the wiper blade 214 has been separated from the pressure drum circumferential surface 22A, thereby avoiding contact with the gripper section 28A. The absorbing roller 215 is abutted against the pressure drum circumferential surface 22A in synchronism with the timing at which the wiper blade 214 is separated from the pressure drum circumferential surface 22A, and the liquid pool 26A created while the wiper blade 214 is separated from the pressure drum circumferential surface 22A is absorbed and removed by the absorbing roller 215. FIG. 14 then shows a state (c) where the liquid pool 26A has been removed by the absorbing roller 215.

When the gripper section 28A has passed the wiping process position of the wiper blade 214, the wiper blade 214 is abutted against the pressure drum circumferential surface 22A and the absorbing roller 215 is separated from the pressure drum circumferential surface 22A as in a state (d) shown in FIG. 14.

An absorbing body (not shown) is arranged in the portion of the absorbing roller 215 that is brought to contact with the pressure drum circumferential surface 22A (namely, the roller surface), and the absorbing roller 215 is composed so as to rotate idly due to the rotation of the pressure drum 22. Moreover, a squeezing roller (not shown) is also arranged, and the liquid having been absorbed by the absorbing body is immediately squeezed out by the squeezing roller and discharged to the exterior of the apparatus though a liquid collecting section (not shown). It is also possible to adopt a structure in which, instead of using the squeezing roller, the absorbing roller is formed with a hollow structure, the absorbing section and the hollow section are connected to each other, and the liquid is collected by applying negative pressure to the hollow section.

According to the cleaning device 200 in the third embodiment, by using the absorbing roller 215 instead of the above-described doctor blade 12 or 112 employed in the first and second embodiments, the liquid pool created while the wiper blade 214 is separated from the pressure drum circumferential surface 22A is removed reliably, and scattering of the liquid to the peripheral area when removing the liquid pool 26A is minimized.

By abutting the absorbing roller 215 against the pressure drum circumferential surface 22A only when removing the liquid pool 26A, it is possible to prolong the lifespan of the absorbing roller 215, as well as preventing the liquid from being transferred back to the pressure drum circumferential surface 22A from the absorbing roller 215.

<Description of Structure of Cleaning Device>

Next, the structure of the cleaning device 200 shown in FIG. 14 is described in detail.

Figure 15:
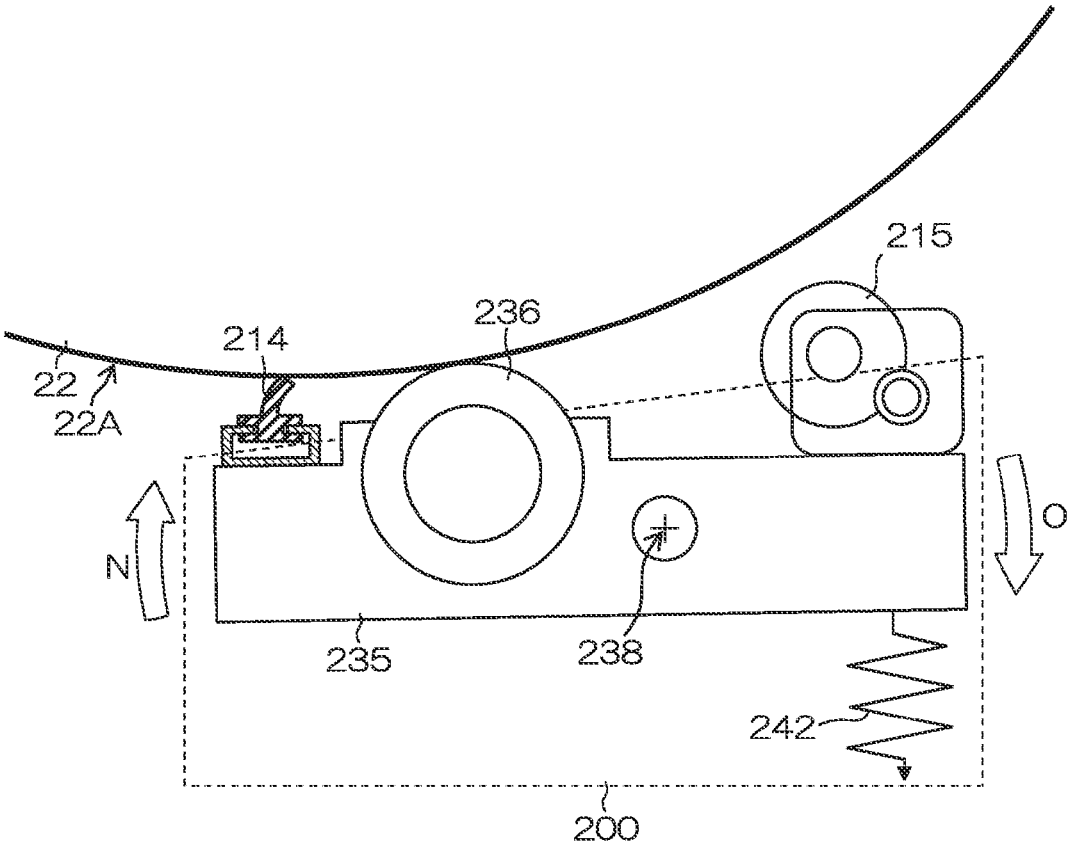
FIG. 15 is a diagram showing a state during a wiping process of the cleaning device according to the third embodiment.

FIG. 15 is a schematic drawing showing the general composition of the cleaning device 200, which has the structure in which the doctor blade 112 shown in FIG. 12 is substituted with the absorbing roller 215. The cleaning device 200 shown in FIG. 15 includes a frame 235, a cam follower 236, a rotary link 238 and a tensile spring 242, which correspond respectively to the frame 135, the cam follower 136, the rotary link 138 and the tensile spring 142' shown in FIG. 12. The directions indicated with arrows N and O in FIG. 15 correspond respectively to the directions indicated with the arrows J and K in FIG. 12.

<Description of Separating Operation of Wiper Blade>

In the cleaning device 200 shown in FIG. 15, in a state where the cam follower 236 is in contact with the pressure drum circumferential surface 22A, the wiper blade 214 is abutted against the pressure drum circumferential surface 22A, the absorbing roller 215 is separated from the pressure drum circumferential surface 22A, and a wiping process is carried out by the wiper blade 214.

Figure 16:
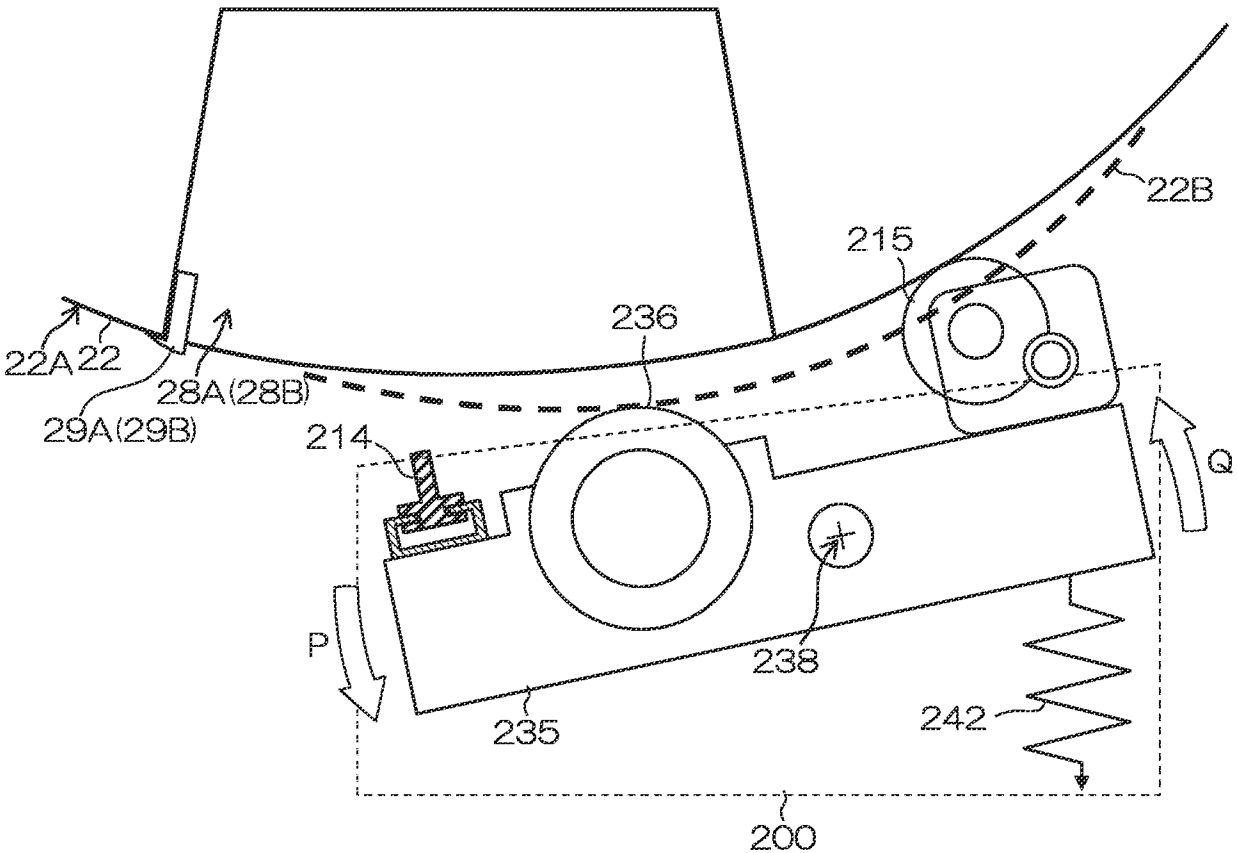
FIG. 16 is a diagram showing a state during separation of the cleaning device shown in FIG. 15.

FIG. 16 shows the cleaning device 200 during the separating step (the state (b) shown in FIG. 14). As shown in FIG. 16, when the cam follower 236 rides up on the cam section 22B arranged on the pressure drum 22 correspondingly to the gripper section 28A (or 28B), the wiper blade 214 is separated from the pressure drum circumferential surface 22A by moving in the direction indicated with an arrow P in FIG. 16, and the absorbing roller 215 is abutted against the pressure drum circumferential surface 22A by moving in the direction indicated with an arrow Q. When the gripper section 28A (or 28B) passes the wiping process position of the wiper blade 214, the cam follower 236 returns from the state of riding up on the cam section 22B to the state of contact with the pressure drum circumferential surface 22A, and the wiper blade 214 is brought to abut against the pressure drum circumferential surface 22A.

It is also possible to adopt a mode in which the liquid pool 26A is removed by pressing a block body made of an absorbing material against the pressure drum circumferential surface 22A, instead of using the absorbing roller 215. However, it is desirable to use a roller-shaped member from the viewpoint of deterioration due to wear of the absorbing body.

FIGS. 14 to 16 show the mode where the wiper blade 214 and the absorbing roller 215 are disposed on the upstream side and the downstream side with respect to each other in terms of the medium conveyance direction; but in the composition where the wiper blade 214 and the absorbing roller 215 can be moved (separated) independently, it is also possible to interchange the arrangement positions of the wiper blade 214 and the absorbing roller 215.

Fourth Embodiment

Next, a method of cleaning a pressure drum using a cleaning device according to a fourth embodiment of the present invention is described.

<Description of Method for Cleaning Circumferential Surface of Pressure Drum>

Figure 17:
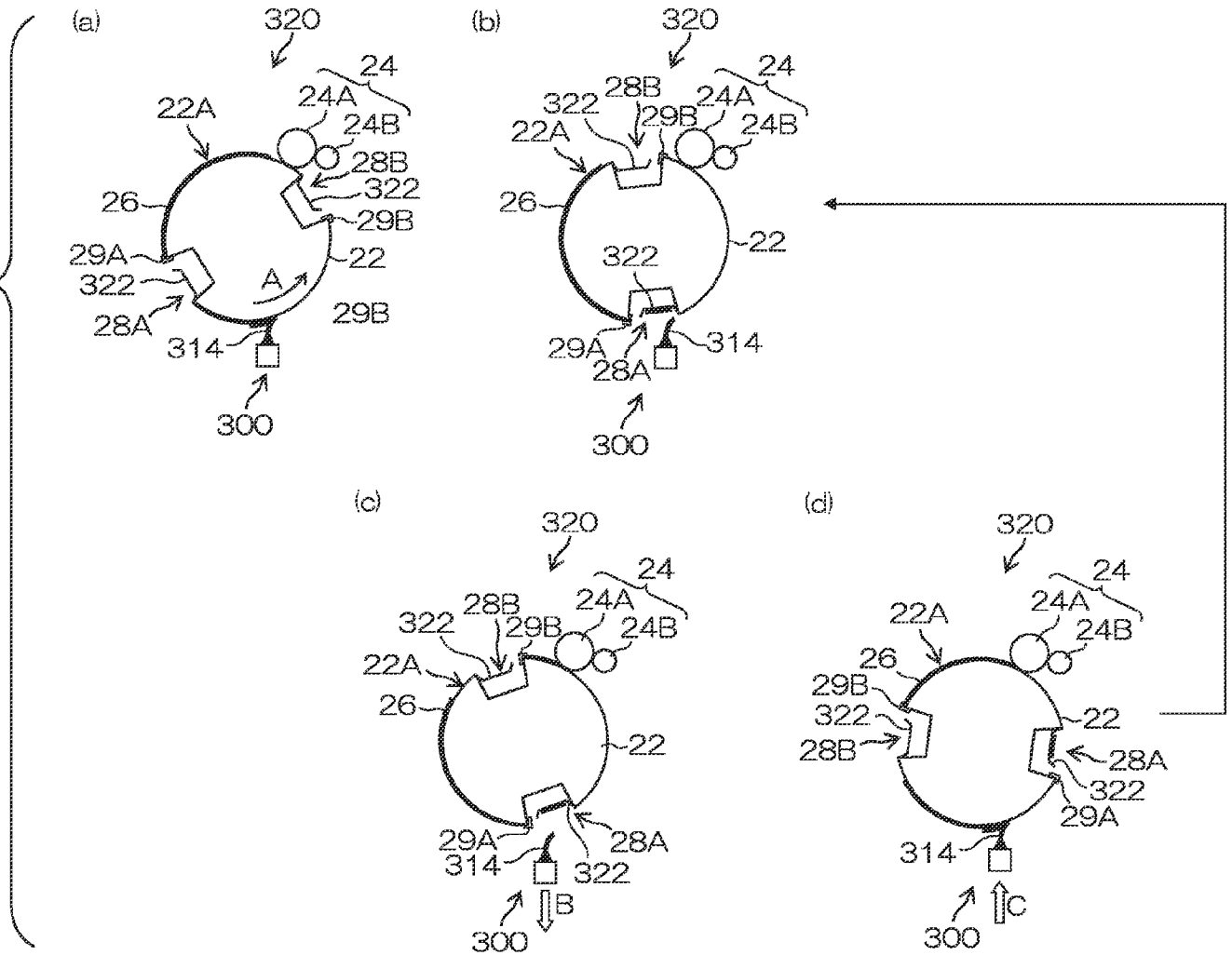
FIG. 17 is a conceptual diagram showing a cleaning method according to a fourth embodiment of the present invention.

FIG. 17 is an illustrative diagram showing schematic views of respective steps of a cleaning process for a pressure drum according to the fourth embodiment of the present invention. Parts which are the same as or similar to those in the first to third embodiments are denoted with the same reference numerals and further explanation thereof is omitted here.

A liquid application device 320 in the present embodiment is provided with a liquid receiving section 322, into which excess liquid wiped by a wiper blade 314 of a cleaning device 300 can flow, in each of the gripper sections 28A and 28B.

FIG. 17 shows a state (a) during the wiping process of the pressure drum circumferential surface 22A by the wiper blade 314, where the wiper blade 314 is abutted against the pressure drum circumferential surface 22A and is removing liquid from the pressure drum circumferential surface 22A. FIG. 17 then shows a state (b) where the wiper blade 214 has been separated from the pressure drum circumferential surface 22A, thereby avoiding contact with the gripper section 28A. The liquid receiving section 322 is arranged on the downstream end portion of the gripper section 28A in the terms of the medium conveyance direction, and the liquid wiped off from the pressure drum circumferential surface 22A by the wiper blade 314 flows into the liquid receiving section 322.

The liquid receiving section 322 is composed in such a manner that the liquid does not fall when the liquid receiving section 322 is facing downward. One example of the internal structure of the liquid receiving section 322 is a mode where an absorbing body is arranged inside same. This absorbing body is replaced periodically.

The timing of separating the wiper blade 314 from the pressure drum circumferential surface 22A can be from immediately after the downstream edge of the gripper section 28A in terms of the medium conveyance direction has passed the wiping process position of the wiper blade 314 until immediately before the upstream edge of the liquid receiving section 322 in terms of the medium conveyance direction arrives at the wiping process position of the wiper blade 314. More specifically, the wiper blade 314 is separated from the pressure drum circumferential surface 22A while the liquid receiving section 322 is situated in the wiping process position of the wiper blade 314.

FIG. 17 then shows a state (c) where the wiper blade 314 is separated from the pressure drum circumferential surface 22A at the timing where an intermediate position of the liquid receiving section 322 reaches the wiping process position of the wiper blade 314.

When the gripper section 28A has passed the wiping process position of the wiper blade 314, the wiper blade 314 is abutted against the pressure drum circumferential surface 22A, and the wiping process from the gripper section 28A to the gripper section 28B (the second wiping step) is carried out as in a state (d) shown in FIG. 17.

According to the cleaning method for the pressure drum in the fourth embodiment, the composition is adopted in which the wiper blade 314 is not separated from the pressure drum circumferential surface 22A until the liquid receiving section 322 arranged in the gripper sections 28A (or 28B) has reached the wiping process position of the wiper blade 314, in such a manner that the liquid wiped away from the pressure drum circumferential surface 22A by the wiper blade 314 flows into the liquid receiving section 322, and hence there is no occurrence of a liquid pool on the pressure drum circumferential surface 22A while the wiper blade 314 is separated from the pressure drum circumferential surface 22A. Furthermore, since the wiper blade 314 is the only cleaning member, then the structure is simplified while also reducing the maintenance requirements compared to the above-descried first to third embodiments.

Embodiment of Application in Inkjet Recording Apparatus

Next, an embodiment in which the cleaning device 10, 10', 10", 100, 100', 200 or 300 and the liquid application device 20 or 320 described above are applied to an inkjet recording apparatus which forms a color image on a recording medium is described. The inkjet recording apparatus described below employs the above-described liquid application device 20 (or 320) in a treatment liquid application unit, which applies an aggregating treatment to a recording medium, and employs the cleaning device 10 (or 10', 10", 100, 100', 200, 300) in a cleaning device for the circumferential surface of a pressure drum in the treatment liquid application unit.

<General Composition of Inkjet Recording Apparatus>

Figure 18:
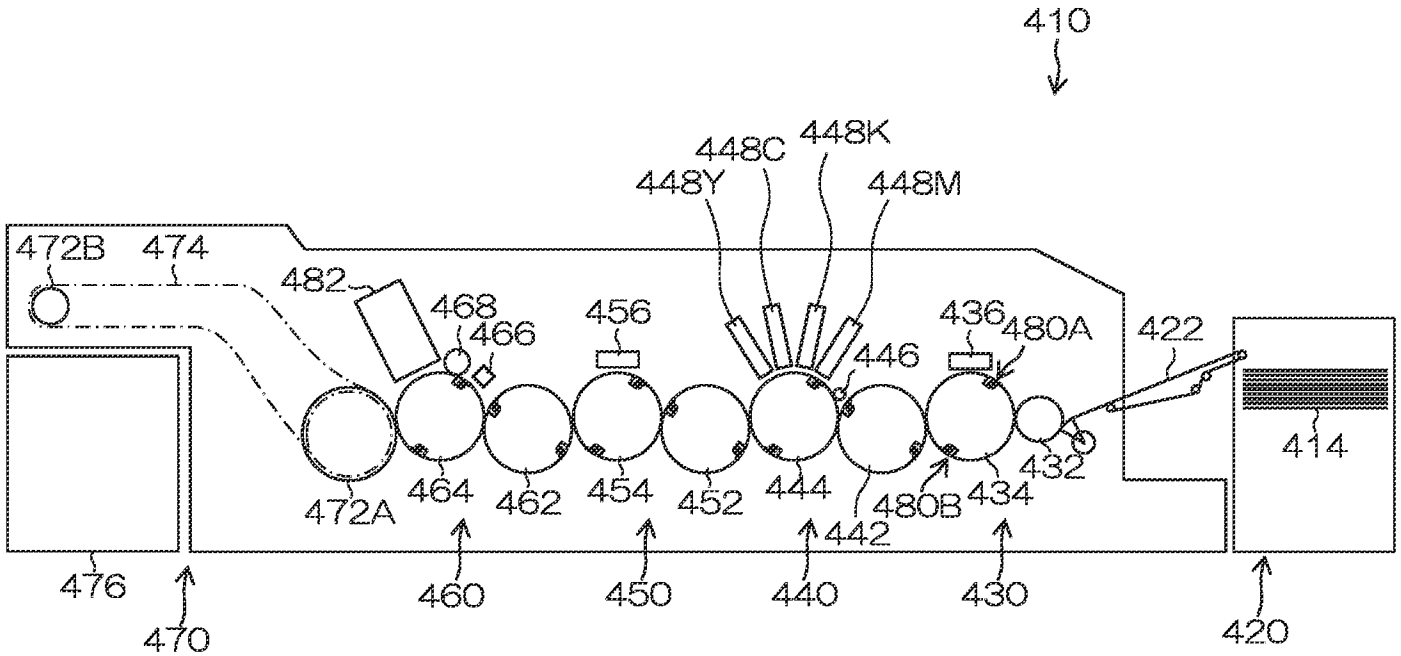
FIG. 18 is a general schematic drawing of an inkjet recording apparatus to which the cleaning device according to the present invention is applied.

FIG. 18 is a schematic drawing showing the general composition of the inkjet recording apparatus according to the present embodiment. The inkjet recording apparatus 410 shown in FIG. 18 is a recording apparatus based on a two-liquid aggregation system which forms an image on a recording surface of a recording medium 414 on the basis of prescribed image data, by using ink containing coloring material and an aggregating treatment liquid having a function of aggregating the ink.

The inkjet recording apparatus 410 includes a paper feed unit 420, the treatment liquid application unit 430, an image formation unit 440, a drying process unit 450, a fixing process unit 460 and an output unit 470. Transfer drums 432, 442, 452 and 462 are arranged as devices which receive and transfer the recording medium 414 conveyed respectively from stages prior to the treatment liquid application unit 430, the image formation unit 440, the drying process unit 450, and the fixing process unit 460. Pressure drums 434, 444, 454 and 464 having a drum shape are arranged as devices for holding and conveying the recording medium 414 respectively in the treatment liquid application unit 430, the image formation unit 440, the drying process unit 450 and the fixing process unit 460.

Each of the transfer drums 432 to 462 and the pressure drums 434 to 464 is provided with grippers 480A and 480B, which grip and hold the leading end portion (or the trailing end portion) of the recording medium 414. The gripper 480A and the gripper 480B adopt a common structure for gripping and holding the leading end portion of the recording medium 414 and for transferring the recording medium 414 with respect to the gripper arranged in another pressure drum or transfer drum; furthermore, the gripper 480A and the gripper 480B are disposed in symmetrical positions separated by 180° in the direction of rotation of the pressure drum 434 on the outer circumferential surface of the pressure drum 434.

When the transfer drums 432 to 462 and the pressure drums 434 to 464 which have gripped the leading end portion of the recording medium 14 by means of the grippers 480A and 480B rotate in a prescribed rotational direction, the recording medium 414 is rotated and conveyed following the outer circumferential surface of the transfer drums 432 to 462 and the pressure drums 434 to 464.

In FIG. 18, only the reference numerals of the grippers 480A and 480B arranged on the pressure drum 434 are indicated, and the reference numerals of the grippers on the other pressure drums and transfer drums are not shown.

When the recording medium (cut sheet paper) 414 accommodated in a paper feed unit 420 is supplied to the treatment liquid application unit 430, the aggregating treatment liquid (hereinafter referred to simply as "treatment liquid") is applied to the recording surface of the recording medium 414 held on the outer circumferential surface of the pressure drum 434. The "recording surface of the recording medium 414" is the outer surface when the recording medium 414 is held by the pressure drums 434 to 464, this being reverse to the surface held on the pressure drums 434 to 464.

Thereupon, the recording medium 414 on which the aggregating treatment liquid has been applied is output to the image formation unit 440 and colored inks are deposited by the image formation unit 440 onto the area of the recording surface where the aggregating treatment liquid has been applied, thereby forming a desired image.

Moreover, the recording medium 414 on which the image has been formed by the colored inks is sent to the drying process unit 450, and a drying process is carried out by the drying process unit 450. After the drying process, the recording medium 414 is conveyed to the fixing process unit 460, and a fixing process is carried out. By carrying out the drying process and the fixing process, the image formed on the recording medium 414 is made durable. In this way, the desired image is formed on the recording surface of the recording medium 414 and after fixing the image on the recording surface of the recording medium 414, the recording medium 414 is conveyed to the exterior of the inkjet recording apparatus 410 through the output unit 470.

The respective units of the inkjet recording apparatus 410 (paper feed unit 420, treatment liquid application unit 430, image formation unit 440, drying process unit 450, fixing process unit 460 and output unit 470) are described in detail below.

<Paper Feed Unit>

The paper feed unit 420 includes a paper feed tray 422 and a paying out mechanism (not shown), and is composed so as to pay out the recording medium 414 one sheet at a time from the paper feed tray 422. The recording medium 414 paid out from the paper feed tray 422 is registered in position by a guide member (not shown) and halted temporarily in such a manner that the leading end portion is disposed at the position of the gripper (not shown) on the transfer drum (paper feed drum) 432.

<Treatment Liquid Application Unit>

The treatment liquid application unit 430 includes: a pressure drum (treatment liquid drum) 434, which holds, on the outer circumferential surface thereof, the recording medium 414 transferred from the paper feed drum 432 and conveys the recording medium 414 in the prescribed conveyance direction; and the treatment liquid application device 436, which applies the treatment liquid to the recording surface of the recording medium 414 held on the outer circumferential surface of the treatment liquid drum 434. When the treatment liquid drum 434 is rotated in the counter-clockwise direction in FIG. 18, the recording medium 414 is conveyed so as to rotate in the counter-clockwise direction following the outer circumferential surface of the treatment liquid drum 434.

The treatment liquid application device 436 shown in FIG. 18 is arranged at a position facing the outer circumferential surface (recording medium holding surface) of the treatment liquid drum 434. One example of the composition of the treatment liquid application device 436 is a mode which includes: a treatment liquid vessel, which stores the treatment liquid; an uptake roller, which is partially immersed in the treatment liquid in the treatment liquid vessel and takes up the treatment liquid from the treatment liquid vessel; and an application roller (rubber roller), which moves the treatment liquid taken up by the uptake roller onto the recording medium 414.

A desirable mode is one which includes an application roller movement mechanism, which moves the application roller in the upward and downward direction (the normal direction with respect to the outer circumferential surface of the treatment liquid drum 434), so as to be able to avoid collisions between the application roller and the grippers 480A and 480B.

The treatment liquid applied on the recording medium 414 by the treatment liquid application device 436 contains a coloring material aggregating agent, which aggregates the coloring material (pigment) in the ink to be deposited by the image formation unit 440, and when the treatment liquid and the ink come into contact with each other on the recording medium 414, the separation of the coloring material and the solvent in the ink is promoted.

It is desirable that the treatment liquid application device 436 doses the amount of treatment liquid applied to the recording medium 414 while applying the treatment liquid, and that the thickness of the film of treatment liquid on the recording medium 414 is sufficiently smaller than the diameter of the ink droplets which are ejected from the image formation unit 440.

The liquid application device (liquid supply device) according to any of the embodiments of the present invention is applied to the treatment liquid application unit 430 (the treatment liquid application device 436).

<Image Formation Unit>

The image formation unit 440 includes: a pressure drum (image formation drum) 444, which holds and conveys the recording medium 414; a paper pressing roller 446 for causing the recording medium 414 to adhere tightly to the image formation drum 444; and inkjet heads 448M, 448K, 448C and 448Y, which deposit the inks onto the recording medium 414. The basic structure of the image formation drum 444 is common to that of the treatment liquid drum 434, which is described previously, and therefore the description of it is omitted here.

The paper pressing roller 446 is a guide member for causing the recording medium 414 to make tight contact with the outer circumferential surface of the image formation drum 444, and is disposed facing the outer circumferential surface of the image formation drum 444, to the downstream side, in terms of the conveyance direction of the recording medium 414, of the transfer position of the recording medium 414 between the transfer drum 442 and the image formation drum 444 and to the upstream side, in terms of the conveyance direction of the recording medium 414, of the inkjet heads 448M, 448K, 448C and 448Y.

When the recording medium 414 that has been transferred from the transfer drum 442 to the image formation drum 444 is conveyed to rotate in a state where the leading end is held by the gripper (not denoted with reference numeral), the recording medium 414 is pressed by the paper pressing roller 446 and is caused to make tight contact with the outer circumferential surface of the image formation drum 444. After the recording medium 414 has been caused to make tight contact with the outer circumferential surface of the image formation drum 444 in this way, the recording medium 414 is passed to a printing region directly below the inkjet heads 448M, 448K, 448C and 448Y, without any floating up of the recording medium 414 from the outer circumferential surface of the image formation drum 444.

The inkjet heads 448M, 448K, 448C and 448Y respectively correspond to the inks of the four colors of magenta (M), black (K), cyan (C) and yellow (Y), and are disposed in this order from the upstream side in terms of the direction of rotation of the image formation drum 444 (the counter-clockwise direction in FIG. 18), and ink ejection surfaces of the inkjet heads 448M, 448K, 448C and 448Y (nozzle surfaces, not shown in FIG. 18 and denoted with reference numeral 500A in FIG. 19) are disposed so as to face the recording surface of the recording medium 414 that is held on the image formation drum 444. Here, the "ink ejection surfaces (nozzle surfaces)" are surfaces of the inkjet heads 448M, 448K, 448C and 448Y which face the recording surface of the recording medium 414, and are the surfaces where the nozzles which eject the inks as described below are formed (these nozzles are not shown in FIG. 18 and are denoted with reference numeral 402 in FIG. 19).

Furthermore, the inkjet heads 448M, 448K, 448C and 448Y shown in FIG. 18 are disposed at an inclination with respect to the horizontal plane in such a manner that the nozzle surfaces of the inkjet heads 448M, 448K, 448C and 448M are substantially parallel to the recording surface of the recording medium 414 that is held on the outer circumferential surface of the image formation drum 444.

The inkjet heads 448M, 448K, 448C and 448Y are full line heads having a length corresponding to the maximum width of the image forming region on the recording medium 414 (the dimension of the recording medium 414 in the direction perpendicular to the conveyance direction), and are fixed so as to extend in a direction perpendicular to the conveyance direction of the recording medium 414.

Nozzles for ejecting the inks are formed in a matrix configuration on the nozzle surfaces (liquid ejection surfaces 500A shown in FIG. 19) of the inkjet heads 448M, 448K, 448C and 448Y throughout the whole width of the image forming region of the recording medium 414.

When the recording medium 414 is conveyed to a printing region directly below the inkjet heads 448M, 448K, 448C and 448Y, inks of respective colors are ejected as droplets on the basis of image data, from the inkjet heads 448M, 448K, 448C and 448Y and deposited onto the region of the recording medium 414 where the aggregating treatment liquid has been applied.

When the droplets of the colored inks are ejected from the corresponding inkjet heads 448M, 448K, 448C and 448Y toward the recording surface of the recording medium 414 held on the outer circumferential surface of the image formation drum 444, the inks make contact with the treatment liquid on the recording medium 414, and an aggregating reaction occurs with coloring material (pigment-based coloring material) that is dispersed in the inks or coloring material (dye-based coloring material) that can be insolubilized, thereby forming an aggregate of the coloring material. Thus, movement of the coloring material in the image formed on the recording medium 414 (namely, positional displacement of the dots, color non-uniformities of the dots) is prevented.

Furthermore, the image formation drum 444 of the image formation unit 440 is structurally separate from the treatment liquid drum 434 of the treatment liquid application unit 430, and therefore the treatment liquid is never applied to the inkjet heads 448M, 448K, 448C and 448Y, and it is possible to reduce the causes of ink ejection abnormalities.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

<Drying Process Unit>

The drying process unit 450 includes: a pressure drum (drying drum) 454, which holds and conveys the recording medium 414 after image formation; and a solvent drying unit 456, which carries out a drying process for evaporating off the water content (liquid component) on the recording medium 414. The basic structure of the drying drum 454 is common to that of the treatment liquid drum 434 and the image formation drum 444 described previously, and therefore further description thereof is omitted here.

The solvent drying unit 456 is a processing unit which is disposed in a position facing the outer circumferential surface of the drying drum 454 and evaporates off the water content present on the recording medium 414. When the ink is deposited on the recording medium 414 by the image formation unit 440, the liquid component (solvent component) of the ink and the liquid component (solvent component) of the treatment liquid that have been separated by the aggregating reaction between the treatment liquid and the ink remain on the recording medium 414, and therefore it is necessary to remove this liquid component.

The solvent drying unit 456 is a processing unit which carries out a drying process by evaporating off the liquid component present on the recording medium 414, through heating by a heater, or air blowing by a fan, or a combination of these, in order to remove the liquid component on the recording medium 414. The amount of heating and the air flow volume applied to the recording medium 414 are set appropriately in accordance with parameters, such as the amount of water remaining on the recording medium 414, the type of recording medium 414, the conveyance speed of the recording medium 414 (interference processing time), and the like.

When the drying process is carried out by the solvent drying unit 456, since the drying drum 454 of the drying process unit 450 is structurally separate from the image formation drum 444 of the image formation unit 440, then it is possible to reduce the causes of ink ejection abnormalities due to drying of the head meniscus portions in the inkjet heads 448M, 448K, 448C and 448Y as a result of the applied heat or air flow.

In order to display an effect in correcting cockling of the recording medium 414, the curvature of the drying drum 454 is desirably 0.002 (1/mm) or greater. Furthermore, in order to prevent curving (curling) of the recording medium after the drying process, the curvature of the drying drum 454 is desirably 0.0033 (1/mm) or less.

Moreover, desirably, a device for adjusting the surface temperature of the drying drum 454 (for example, an internal heater) may be provided to adjust the surface temperature to 50° C. or above. Drying is promoted by carrying out a heating process from the rear surface of the recording medium 414, thereby preventing destruction of the image in the subsequent fixing process. According to this mode, more beneficial effects are obtained if a device for causing the recording medium 414 to adhere tightly to the outer circumferential surface of the drying drum 454 is provided. Examples of a device for causing tight adherence of the recording medium 414 include a vacuum suction device, electrostatic attraction device or the like.

There are no particular restrictions on the upper limit of the surface temperature of the drying drum 454, but from the viewpoint of the safety of maintenance operations such as cleaning the ink adhering to the surface of the drying drum 454 (e.g. preventing burns due to high temperature), desirably, the surface temperature of the drying drum 454 is not higher than 75° C. (and more desirably, not higher than 60° C.).

By holding the recording medium 414 in such a manner that the recording surface thereof is facing outward on the outer circumferential surface of the drying drum 454 having this composition (in other words, in a state where the recording surface of the recording medium 414 is curved in a projection shape), and carrying out the drying process while conveying the recording medium 414 in rotation, it is possible reliably to prevent drying non-uniformities caused by wrinkling or floating up of the recording medium 414.

<Fixing Process Unit>

The fixing process unit 60 includes: a pressure drum (fixing drum) 464, which holds and conveys the recording medium 414; a heater 466, which carries out a heating process on the recording medium 414 which the image has been formed on and the liquid has been removed from; and a fixing roller 468, which presses the recording medium 414 from the recording surface side. The basic structure of the fixing drum 464 is common to that of the treatment liquid drum 434, the image formation drum 444 and the drying drum 454, and description thereof is omitted here. The heater 466 and the fixing roller 468 are disposed in positions facing the outer circumferential surface of the fixing drum 464, and are situated in this order from the upstream side in terms of the direction of rotation of the fixing drum 464 (the counter-clockwise direction in FIG. 18).

In the fixing process unit 60, a preliminary heating process by means of the heater 466 is carried out onto the recording surface of the recording medium 414, and a fixing process by means of the fixing roller 468 is also carried out. The heating temperature of the heater 466 is set appropriately in accordance with the type of the recording medium, the type of ink (the type of polymer particles contained in the ink), and the like. For example, a possible mode is one where the heating temperature is set to the glass transition temperature or the minimum film forming temperature of the polymer particles contained in the ink.

The fixing roller 468 is a roller member for melting the self-dispersing polymer particles contained in the ink and thereby causing a state where the ink is covered with a film, by applying heat and pressure to the dried ink, and is composed so as to apply heat and pressure to the recording medium 414. More specifically, the fixing roller 468 is disposed so as to contact and press against the fixing drum 464, in such a manner that the fixing roller 468 serves as a nip roller with respect to the fixing drum 464. By this means, the recording medium 414 is held between the fixing roller 468 and the fixing drum 464 and is nipped with a prescribed nip pressure, whereby the fixing process is carried out.

An example of the composition of the fixing roller 468 is a mode where the fixing roller 468 is constituted of a heating roller which incorporates a halogen lamp inside a metal pipe made of aluminum, or the like, having good heat conductivity. If heat energy at or above the glass transition temperature of the polymer particles contained in the ink is applied by heating the recording medium 414 by means of this heating roller, then the polymer particles melt and a transparent film is formed on the surface of the image.

By applying pressure to the recording surface of the recording medium 414 in this state, the polymer particles which have melted are pressed and fixed into the undulations in the recording medium 414, and the undulations in the image surface are thereby leveled out, thus making it possible to obtain a desirable luster. A desirable composition is one where fixing rollers 468 are provided in a plurality of stages, in accordance with the thickness of the image layer and the glass transition temperature characteristics of the polymer particles.

Furthermore, desirably, the surface hardness of the fixing roller 468 is not higher than 71°. By further softening the surface of the fixing roller 468, it is possible to expect effects in following the undulations of the recording medium 414 which are produced by cockling, and fixing non-uniformities caused by the undulations of the recording medium 414 are prevented more effectively.

The inkjet recording apparatus 410 shown in FIG. 18 includes an in-line sensor 482, which is arranged at a later stage of the processing region of the fixing process unit 460 (on the downstream side in terms of the direction of conveyance of the recording medium). The in-line sensor 482 is a sensor for reading the image formed on the recording medium 414 (or a test pattern (check pattern) formed in the margin area of the recording medium 414), and desirably employs a CCD line sensor.

In the inkjet recording apparatus 410 in the present embodiment, the presence and absence of ejection abnormalities in the inkjet heads 448M, 448K, 448C and 448Y are judged on the basis of the reading results of the in-line sensor 482. Furthermore, the in-line sensor 482 may include measurement devices for measuring the water content, surface temperature, luster (gloss level), and the like. According to this mode, parameters, such as the processing temperature of the drying process unit 450 and the heating temperature and applied pressure of the fixing process unit 460, are adjusted appropriately on the basis of the read result for the water content, surface temperature and luster, and thereby the above control parameters are properly controlled in accordance with the temperature alteration inside the apparatus and the temperature alteration of the respective parts.

<Output Unit>

As shown in FIG. 18, the output unit 470 is arranged subsequently to the fixing process unit 460. The output unit 470 includes an endless conveyance belt 474 wrapped about tensioning rollers 472A and 472B, and an output tray 476, in which the recording medium 414 after the image formation is accommodated.

The recording medium 414 that has undergone the fixing process and output from the fixing process unit 460 is conveyed by the conveyance belt 474 and output to the output tray 476.

<Structure of Inkjet Head>

Next, the structure of the inkjet heads 448M, 448K, 448C and 448Y arranged in the image formation unit 440 is described. The inkjet heads 448M, 448K, 448C and 448Y corresponding to the respective colors have a common structure, and therefore these inkjet heads are represented by an inkjet head (hereinafter referred to simply as "head") denoted with reference numeral 500 below.

Figure 19:
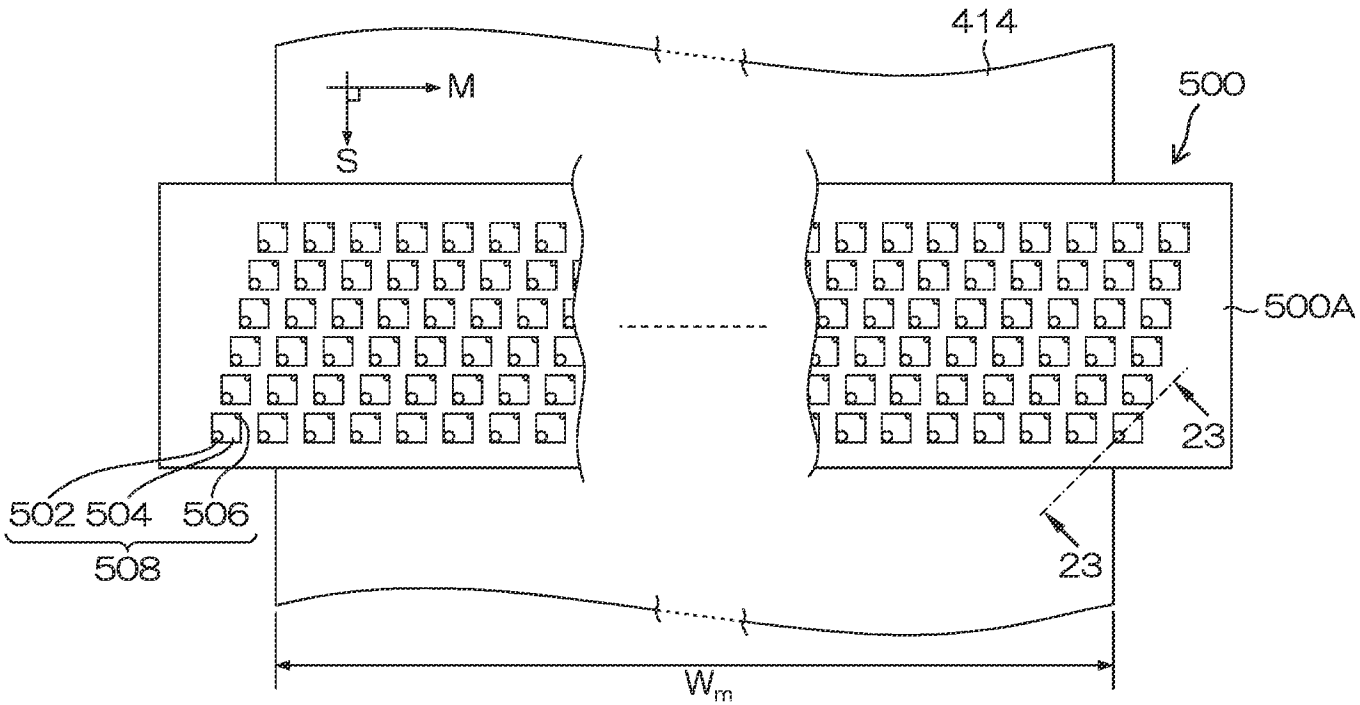
FIG. 19 is a plan view perspective diagram showing an embodiment of the inkjet head shown in FIG. 18.

FIG. 19 is a plan view perspective diagram showing an embodiment of the structure of the head 500. In the description below, parts which are the same as or similar to those described previously are denoted with the same reference numerals and further explanation thereof is omitted.

As shown in FIG. 19, the head 500 is a full line type of head having a structure in which a plurality of nozzles 502 are arranged through a length corresponding to the full width Wm of the recording medium 414, on the nozzle surface 500A of the head 500. The conveyance direction S of the recording medium 414 may be called the sub-scanning direction, and the direction M, which is perpendicular to the conveyance direction S of the recording medium 414, may be called the main scanning direction.

In order to minimize the dot pitch formed onto the surface of the recording medium 414, it is necessary to minimize the nozzle pitch in the head 500. As shown in FIG. 19, the head 500 according to the present embodiment has a structure in which a plurality of ink chamber units (liquid droplet ejection elements forming recording element units) 508 are arranged in a matrix configuration, each ink chamber unit having the nozzle 502 which is an ink ejection port, a pressure chamber 504 connected to the nozzle 502 and a supply port 506 which connects the pressure chamber 504 to a common flow channel (not shown), whereby a high density of the nozzles is achieved by minimizing the effective nozzle interval that is obtained by projecting the nozzles in the main scanning direction, which is the lengthwise direction of the head 500 (the projected nozzle pitch Pn in FIG. 20).

The pressure chamber 504 connected to the nozzle 502 has an approximately square planar shape, the nozzle 502 being arranged in one of two corners on a diagonal line and the supply port 506 being arranged in the other corner. The shape of the pressure chamber 504 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

Figure 20:
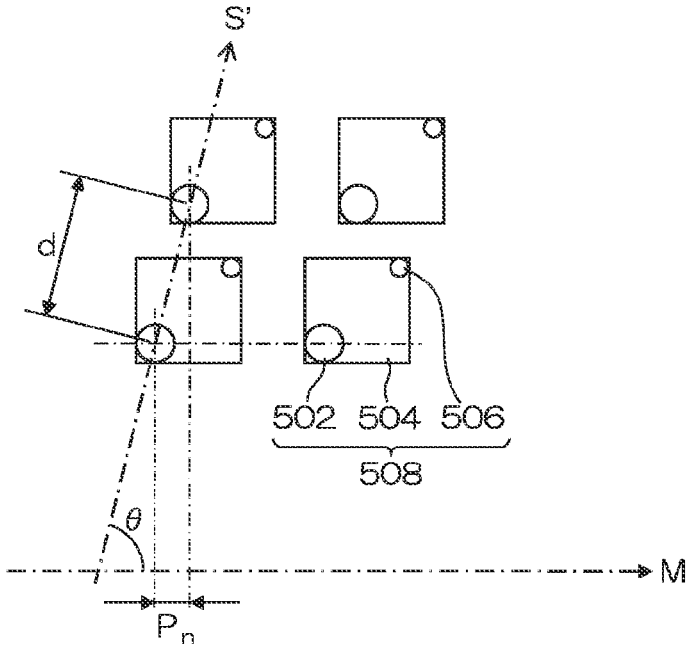
FIG. 20 is a partial enlarged diagram of the inkjet head shown in FIG. 19.

FIG. 20 shows an enlarged view of a portion of the head 500 shown in FIG. 19. As shown in FIG. 20, the high-density nozzle head of the present embodiment is achieved by arranging the ink chamber units 508 having the nozzles 502, pressure chambers 504, and the like, in the matrix configuration according to a prescribed arrangement pattern following a row direction aligned in the main scanning direction M and an oblique column direction S', which is inclined by a prescribed angle θ ($0°<\theta<90°$) with the main scanning direction M.

More specifically, by adopting the structure in which the plurality of ink chamber units 508 are arranged at a uniform pitch d in line with the oblique column direction S' forming the angle of θ with respect to the main scanning direction M, the projected nozzle pitch Pn of the nozzles projected to an alignment in the main scanning direction M is $d \times \cos\theta$, and hence it is possible to treat the nozzles 502 as if they are arranged linearly at a uniform pitch of Pn. By means of this composition, it is possible to achieve a high-density arrangement, in which the nozzle rows projected to an alignment in the main scanning direction M reach a total of 2400 per inch (2400 nozzles per inch).

Figure 21:
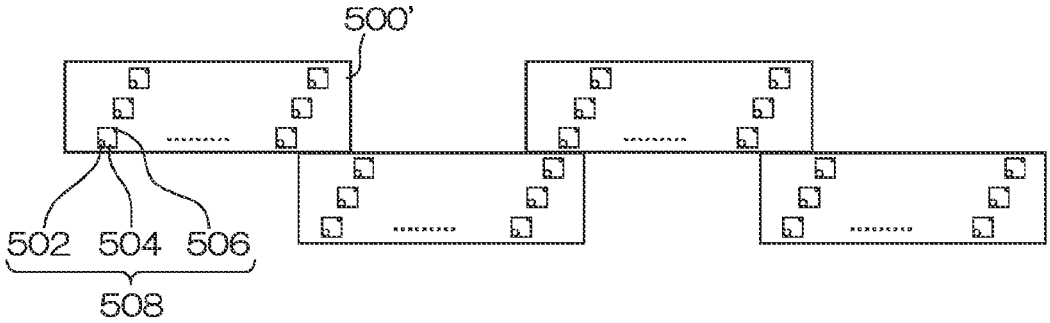
FIG. 21 is a plan view perspective diagram showing a further embodiment of the composition of the inkjet head shown in FIG. 19.

An embodiment constituting one or more nozzle rows covering a length corresponding to the full width Wm of the recording medium 414 is not limited to the present embodiment. For example, instead of the composition in FIG. 19, as shown in FIG. 21, a line head having nozzle rows of a length corresponding to the entire width of the recording medium 414 can be formed by arranging and combining, in a staggered matrix, short head modules 500' each having a plurality of nozzles 502 arrayed in a two-dimensional fashion, to achieve a long dimension.

Figure 22:
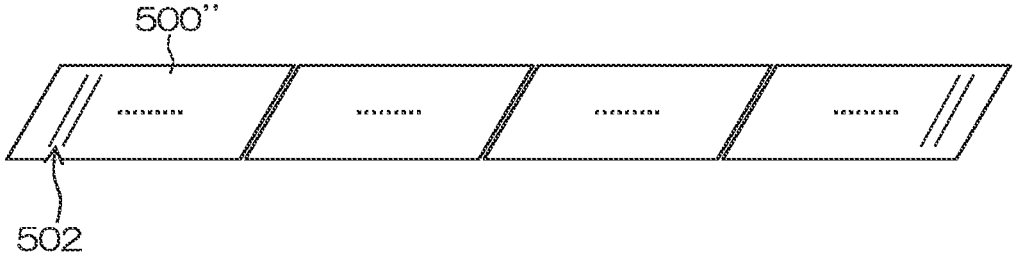
FIG. 22 is a plan view perspective diagram showing yet a further embodiment of the composition of the inkjet head shown in FIG. 19.

Furthermore, as shown in FIG. 22, a line head may also be formed by aligning in one row short head modules 200" which each do not cover the full width of the recording medium 414. In FIG. 22, the nozzles 502 arranged in the column direction (see FIG. 20) are depicted with oblique solid lines.

Figure 23:
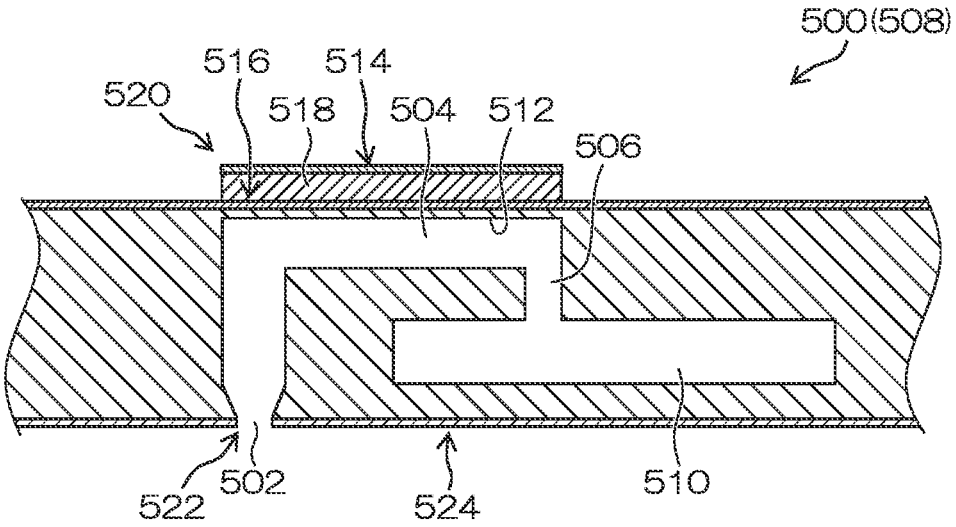
FIG. 23 is a cross-sectional diagram along line 23-23 in FIG. 19.

FIG. 23 is a cross-sectional diagram (along line 23-23 in FIG. 19) showing the structure of the head 500 (ink chamber unit 508) in FIG. 19.

The pressure chambers 504, which are connected to the nozzles 502, are linked through the supply ports 506 to the common flow channel 510. The common flow channel 510 is connected to an ink tank (not shown), which is a base tank that supplies the ink, and the ink supplied from the ink tank is supplied through the common flow channel 510 to the pressure chambers 504.

A piezoelectric element 520 is constituted of an individual electrode 514, a common electrode 516 and a piezoelectric body 518, and has a structure in which the piezoelectric body 518 is arranged between the individual electrode 514 and the common electrode 516. The piezoelectric element 520 is bonded to a diaphragm 512, which constitutes the upper surface of the pressure chambers 504. The head 500 shown in FIG. 23 has a structure in which a nozzle plate 524 in which openings 522 of the nozzles 502 are formed is bonded to a body in which a flow channel structure having the pressure chambers 504, supply ports 506, common flow channel 510, and the like, are formed.

The piezoelectric elements 520 and the diaphragm 512 deform when a prescribed drive voltage is applied between the individual electrodes 514 and the common electrode 516, and the volume of the pressure chambers 504 change accordingly. A pressure change occurs in the ink inside the pressure chamber 504 due to the volume change in the pressure chamber 504, and the ink of a volume corresponding to the volume change in the pressure chamber 504 is ejected from the nozzle 502. After ejecting the ink, when the piezoelectric element 520 and the diaphragm 512 return to their original state, new ink is filled into the pressure chamber 504 from the common flow channel 510 through the supply port 506.

In the present embodiment, the piezoelectric element 520 is used as the ink ejection force generating device, which causes the ink to be ejected from the nozzle 502 in the head 500; however, it is also possible to employ a thermal method in which a heater is arranged inside the pressure chamber 504 and the ink is ejected by using the pressure of the film boiling action caused by the heating action of this heater.

<Description of Control System>

Figure 24:
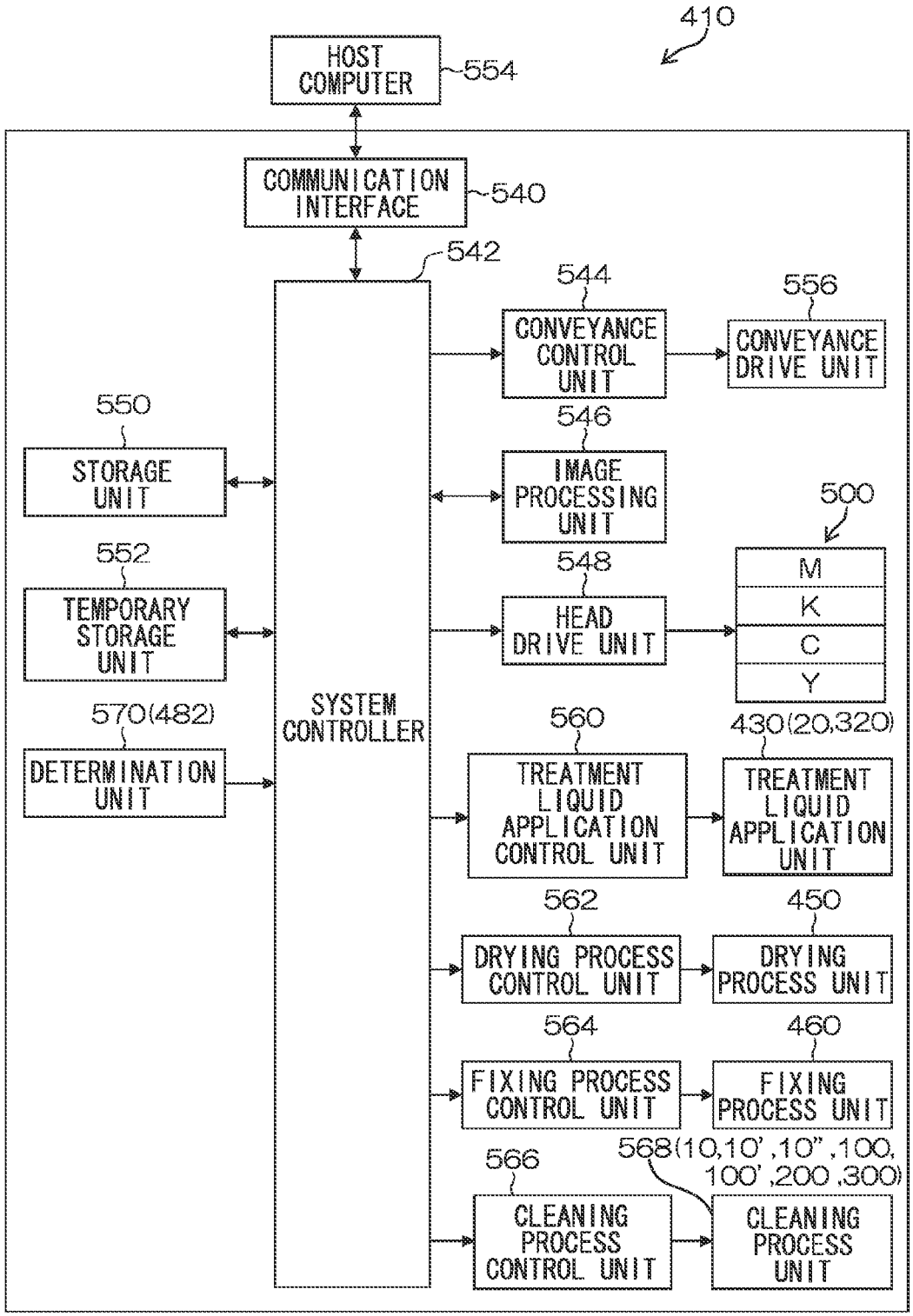
FIG. 24 is a principal block diagram showing the system configuration of the inkjet recording apparatus shown in FIG. 18.
Figure 25:
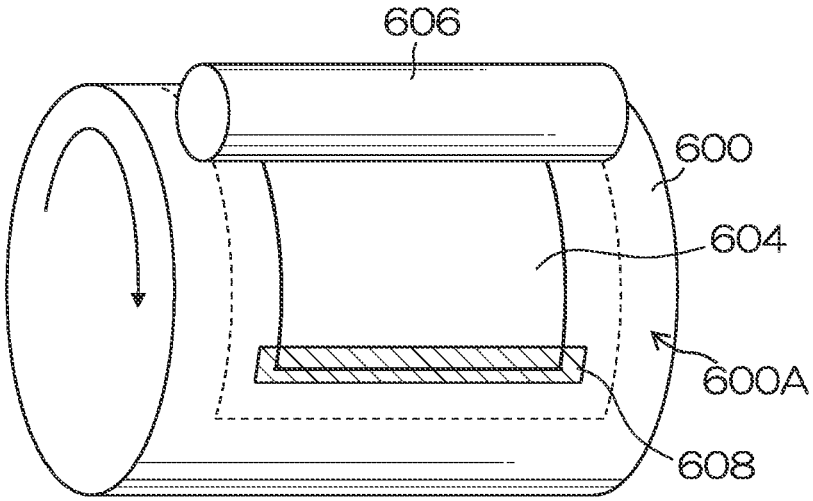
FIG. 25 RELATED ART
FIG. 25 is a diagram describing the problems of a method for cleaning the circumferential surface of a pressure drum in the related art.

FIG. 24 is a block diagram showing the general composition of the control system of the inkjet recording apparatus 410. The inkjet recording apparatus 410 includes a communication interface 540, a system controller 542, a conveyance control unit 544, an image processing unit 546, a head drive unit 548, a storage unit (memory) 550, and a temporary storage unit 552.

The communication interface 540 is an interface unit for receiving image data transmitted from a host computer 554. The communication interface 540 may employ a serial interface, such as a USB (Universal Serial Bus), or a parallel interface, such as a Centronics device. It is also possible to install a buffer memory (not shown) in the communication interface 540 for achieving high-speed communications.

The system controller 542 is constituted of a central processing unit (CPU) and peripheral circuits of same, and the like, and functions as a device for controlling the whole of the inkjet recording apparatus 410 in accordance with a prescribed program, as well as functioning as a calculating device which performs various calculations and also functioning as a memory controller for the storage unit 550 and the temporary storage unit 552. In other words, the system controller 542 controls the various sections, such as the communication interface 540, the conveyance control unit 544, and the like, as well as controlling communications with the host computer 554 and reading and writing to and from the storage unit 550 and the temporary storage unit 552, and the like, and generating control signals which control the respective units described above.

The image data sent from the host computer 554 is input to the inkjet recording apparatus 410 though the communication interface 540, and prescribed image processing is carried out by the image processing unit 546.

The image processing unit 546 is a control unit which has signal (image) processing functions for carrying out various treatments, corrections and other processing in order to generate a signal for controlling printing from the image data, and which supplies the generated print data to the head drive unit 548. Required signal processing is carried out in the image processing unit 546, and the droplet ejection volume (i.e., droplet deposition volume) and the ejection timing of the head 500 are controlled through the head drive unit 548 on the basis of the image data. Thus, a desired dot size and dot arrangement are achieved. The head drive unit 548 shown in FIG. 24 may also include a feedback control system for maintaining uniform drive conditions in the head 500.

The conveyance control unit 544 controls the conveyance timing and conveyance speed of the recording medium 414 (see FIG. 18) on the basis of the print control signal generated by the image processing unit 546. A conveyance drive unit 556 in FIG. 24 includes motors which rotate the pressure drums 434 to 464 in FIG. 18, motors which rotate the transfer drums 432 to 462, a motor of the conveyance mechanism of the recording medium 414 in the paper supply unit 420, a motor which drives the tensioning roller 472A (472B) of the output unit 470, and the like, and the conveyance control unit 544 functions as a driver for the above-described motors.

The storage unit 550 stores programs which are executed by the CPU of the system controller 542, and various data and control parameters, and the like, which are necessary for controlling the respective sections of the apparatus, and reading and writing of the data are performed through the system controller 542. The storage unit 550 is not limited to a memory constituted of semiconductor elements, and may also employ a magnetic medium, such as a hard disk. Furthermore, the storage unit 550 may also have an external interface and use a detachable storage medium.

The temporary storage unit (primary storage memory) 552 has the functions of a temporary storage device for temporarily storing image data input through the communication interface 540, and the functions of a development area for various programs stored in the storage unit 550 and a calculation work area for the CPU (for example, a work area for the image processing unit 546). A volatile memory (RAM) which can be read from and written to sequentially is used as the temporary storage unit 552.

The inkjet recording apparatus 410 further includes a treatment liquid application control unit 560, a drying process control unit 562, a fixing process control unit 564 and a cleaning process control unit 566, which respectively control the operation of the respective sections of the treatment liquid application unit 430, the drying process unit 450, the fixing process unit 460 and a cleaning process unit 568 in accordance with instructions from the system controller 542.

The treatment liquid application control unit 560 controls the timing of treatment liquid application, as well as controlling the amount of treatment liquid applied, on the basis of print data obtained from the image processing unit 546. The drying process control unit 562 controls the timing of the drying process, as well as controlling the process temperature, air flow volume, and the like. The fixing process control unit 564 controls the temperature of the heater 466 as well as the application pressure of the fixing roller 468.

The cleaning process control unit 566 controls the cleaning operation of the cleaning process unit 568. The cleaning process unit 568 in FIG. 24 includes at least one of the cleaning devices 10, 10', 10", 100, 100', 200 and 300. The cleaning process unit 568 (the cleaning device 10, 10', 10", 100, 100', 200 or 300) can be used as a cleaning device for the pressure drums 444, 454 and 464, as well as the pressure drum 434 of the treatment liquid application unit 430. Moreover, it is also possible to appropriately combine the cleaning devices 10, 10', 10", 100, 100', 200 and 300, in accordance with the liquid applied to the pressure drum that is the cleaning object and the structure of the pressure drum. Furthermore, it is also possible to provide a common cleaning device for the pressure drums 434 to 464 arranged in the inkjet recording apparatus 410 and to adopt a composition whereby the cleaning device can be moved between the respective units by a movement mechanism.

A determination unit 570 is a processing block which includes the in-line sensor 482 shown in FIG. 18, and a signal processing unit for carrying out prescribed signal processing, such as noise removal, amplification, waveform shaping, and the like, of the read signal output from the in-line sensor 482. The system controller 542 judges the presence or absence of ejection abnormalities in the head 500 on the basis of the determination signal obtained by the determination unit 570.

In the embodiments of the apparatus composition given above, the inkjet recording apparatus has been described which records a color image by ejecting color inks onto a recording medium as an example of the image forming apparatus, but the liquid application device (liquid supply device) according to the present invention may also be applied to an image forming apparatus which forms a prescribed pattern shape on a substrate by means of a resin liquid, or the like, in order, for instance, to form a mask pattern or to print wiring of a printed wiring substrate.

The liquid application device (liquid supply device) and image forming apparatus according to the present invention have been described in detail above, but the present invention is not limited to the aforementioned embodiments, and it is of course possible for improvements or modifications of various kinds to be implemented, within a range which does not deviate from the scope of the present invention.

APPENDIX

As has become evident from the detailed description of the embodiments of the present invention given above, the present specification includes disclosure of various technical ideas described below.

It is preferable that a cleaning device comprises: a wiper blade which is arranged along an axial direction of a pressure drum holding and conveying a medium on which liquid is applied, the pressure drum holding the medium on a pressure drum circumferential surface of the pressure drum and conveying the medium in a prescribed medium conveyance direction, the wiper blade wiping and removing the liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction; a movement device which moves the wiper blade so as to separate the wiper blade from the pressure drum circumferential surface when a gripping member arranged on the pressure drum to hold an end portion of the medium passes a wiping process position of the wiper blade; and a liquid pool removal device which removes at least a portion of the liquid in a liquid pool formed by the liquid that has been wiped by the wiper blade immediately before the wiper blade is separated from the pressure drum circumferential surface and that has not slid completely down the wiper blade face.

According to this aspect of the present invention, the liquid pool, which is formed on the pressure drum circumferential surface due to the wiper blade being separated from the pressure drum circumferential surface when the gripping member which grips the end portion of the medium arranged on the pressure drum passes the wiping process position of the wiper blade, is removed, and accumulation of liquid in the liquid pool is prevented.

The liquid pool removal device should be capable of suppressing accumulation of liquid in a liquid pool and preventing the liquid from trickling on the pressure drum circumferential surface from the liquid pool, and should be capable of removing the liquid in the liquid pool in such a manner that the liquid contained in the liquid pool does not move.

Preferably, the liquid pool removal device includes a doctor blade which is arranged along the axial direction of the pressure drum, the doctor blade removing at least a portion of the liquid in the liquid pool in one of a contact state and a non-contact proximate state with the pressure drum circumferential surface, the doctor blade being disposed in such a manner that a doctor blade face of the doctor blade is inclined from a normal to the pressure drum circumferential surface at a proximate position to the doctor blade face to form an angle of larger than 90° between the doctor blade face and the pressure drum circumferential surface on an upstream side from the proximate position in terms of the medium conveyance direction.

According to this aspect of the present invention, by removing at least a portion of the liquid in the liquid pool, it is possible to prevent the trickling of the liquid due to accumulation of the liquid in the liquid pool.

A desirable mode is one where the doctor blade is brought to contact with the pressure drum circumferential surface. A clearance within a prescribed range is allowed between the doctor blade and the pressure drum circumferential surface. For example, the shortest distance between the doctor blade and the pressure drum circumferential surface is not smaller than 0.05 mm and not larger than 0.2 mm.

Preferably, the doctor blade is disposed to an upstream side of the wiper blade in terms of the medium conveyance direction; and the movement device has a structure which unitedly separates the wiper blade and the doctor blade from the pressure drum circumferential surface.

According to this aspect of the present invention, by arranging the doctor blade on the upstream side of the wiper blade in terms of the medium conveyance direction, the liquid that has passed below the edge of the doctor blade arrives at the wiping process position of the wiper blade and therefore abrasion of the wiper blade is suppressed and the occurrence of abrasive marks in the pressure drum circumferential surface is prevented. These beneficial effects are valuable in the case of removing a thin layer of liquid formed by a liquid of low viscosity.

One example of such a mode is a mode where the cleaning device further comprises a frame member on which a wiper blade supporting member that supports the wiper blade and a doctor blade supporting member that supports the doctor blade are unitedly fixed, and the frame is moved by the movement device.

One example of the movement device has a structure in which the frame member has a cam follower which moves idly with the movement of the pressure drum circumferential surface and a cam section arranged on the pressure drum circumferential surface, and when the cam follower moves over the pressure drum circumferential surface, the whole of the frame member is impelled toward the pressure drum circumferential surface by a prescribed impelling force, and when the cam follower moves over the cam section, the whole of the frame member is separated from the pressure drum circumferential surface.

Preferably, the movement device separates the wiper blade and the doctor blade from the pressure drum circumferential surface after a recess section in the pressure drum circumferential surface in which the gripping member is disposed arrives at a wiping process position of the doctor blade and before the recess section arrives at the wiping process position of the wiper blade.

According to this aspect of the present invention, collisions between the wiper blade and the gripper member are avoided, and damage to the wiper blade and the gripper member is prevented.

Preferably, the movement device moves the wiper blade and the doctor blade in such a manner that the wiper blade is brought to contact with the pressure drum circumferential surface and the doctor blade is brought to the one of the contact state and the non-contact proximate state with the pressure drum circumferential surface, after the recess section passes the wiping process position of the wiper blade.

According to this aspect of the present invention, at least a portion of the liquid in the liquid pool that has passed the wiping process position of the wiper blade and the wiping process position of the doctor blade is removed by wiping by the doctor blade after the pressure drum has performed substantially one whole revolution, and therefore accumulation of the liquid in the liquid pool is prevented reliably.

Preferably, the doctor blade is disposed to a downstream side of the wiper blade in terms of the medium conveyance direction; the movement device has a structure which severally separates the wiper blade and the doctor blade from the pressure drum circumferential surface; and at a timing that a recess section in the pressure drum circumferential surface in which the gripping member is disposed arrives at the wiping process position of the wiper blade, the movement device separates the wiper blade from the pressure drum circumferential surface and brings the doctor blade to the one of the contact state and the non-contact proximate state with the pressure drum circumferential surface to make the doctor blade remove at least a portion of the liquid in the liquid pool.

According to this aspect of the present invention, the wiping process by the doctor blade is carried out immediately after the liquid pool has formed, and therefore it is possible to prevent accumulation of the liquid in the liquid pool reliably. Furthermore, since the doctor blade is used only when removing the liquid pool, a long lifespan of the doctor blade can be expected.

Preferably, the doctor blade is disposed to a downstream side of the wiper blade in terms of the medium conveyance direction; and the movement device has a structure which unitedly moves the wiper blade and the doctor blade, and at a timing that a recess section in the pressure drum circumferential surface in which the gripping member is disposed arrives at the wiping process position of the wiper blade, the structure separates the wiper blade from the pressure drum circumferential surface and brings the doctor blade to the one of the contact state and the non-contact proximate state with the pressure drum circumferential surface.

According to this aspect of the present invention, the composition of the movement device and the control of the movement device are simplified compared to a mode where a device for moving the wiper blade and a device for moving the doctor blade are arranged separately.

Preferably, a part of the pressure drum circumferential surface on an upstream side of a trailing end position of the medium of maximum size in terms of the medium conveyance direction is provided with a liquid repelling treatment.

According to this aspect of the present invention, by providing the liquid repelling treatment on the position where the liquid pool forms, the removal of the liquid pool is made easier.

Preferably, the cleaning device further comprises a wetting device which wets the pressure drum circumferential surface and is disposed to an upstream side of the wiper blade in terms of the medium conveyance direction.

According to this aspect of the present invention, it is possible to carry out wet wiping due to liquid being interposed between the wiper blade and the pressure drum circumferential surface during the wiping process by the wiper blade.

One example of the wetting device is a mode where the liquid is taken up from a liquid collecting section which accommodates the liquid that has been removed by the wiper blade, and the liquid thus taken up is supplied to the pressure drum circumferential surface. Furthermore, it is also possible to apply a cleaning liquid to the pressure drum circumferential surface by means of a spray method, or the like.

Preferably, the liquid pool removal device includes an absorbing device which is disposed to a downstream side of the wiper blade in terms of the medium conveyance direction and is brought to contact with the pressure drum circumferential surface to absorb and remove the liquid in the liquid pool.

One example of the absorbing device is a mode which adopts a roller shape that rotates idly on the pressure drum circumferential surface due to the rotation of the pressure drum.

Preferably, the movement device has a structure which unitedly moves the wiper blade and the absorbing device, and at a timing that a recess section in the pressure drum circumferential surface in which the gripping member is disposed arrives at the wiping process position of the wiper blade, the structure separates the wiper blade from the pressure drum circumferential surface and brings the absorbing device to contact with the pressure drum circumferential surface.

According to this aspect of the present invention, scattering of the liquid to the peripheral area is suppressed compared to wiping by a blade, or the like. Furthermore, since the absorbing device is used only to remove the liquid pool, a long lifespan of the absorbing device can be expected.

It is also preferable that a liquid application device comprises: a pressure drum which holds a medium on a pressure drum circumferential surface of the pressure drum and conveys the medium in a prescribed medium conveyance direction, the pressure drum having a gripping member to hold an end portion of the medium; a liquid application unit which applies liquid to the medium held on the pressure drum circumferential surface; and a cleaning device which includes: a wiper blade which is arranged along an axial direction of the pressure drum and wipes and removes the liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction; a movement device which moves the wiper blade so as to separate the wiper blade from the pressure drum circumferential surface when the gripping member passes a wiping process position of the wiper blade; and a liquid pool removal device which removes at least a portion of the liquid in a liquid pool formed by the liquid that has been wiped by the wiper blade immediately before the wiper blade is separated from the pressure drum circumferential surface and that has not slid completely down the wiper blade face.

Preferably, the liquid pool removal device includes a liquid receiving device which is arranged inside a recess section in the pressure drum circumferential surface in which the gripping member is disposed; and the liquid application device further comprises a movement control device which controls the movement device to separate the wiper blade from the pressure drum circumferential surface at a timing that the liquid receiving device arrives at the wiping process position of the wiper blade.

According to this aspect of the present invention, the formation of a liquid pool when the wiper blade is separated from the pressure drum circumferential surface is prevented. Furthermore, the liquid adhering to the pressure drum circumferential surface can be removed reliably by means of a simple structure and furthermore, the maintenance tasks are made easier.

The liquid receiving device according to this mode desirably has an absorbing member arranged therein for absorbing the liquid.

It is also preferable that an image forming apparatus comprises: a pressure drum which holds a medium on a pressure drum circumferential surface of the pressure drum and conveys the medium in a prescribed medium conveyance direction, the pressure drum having a gripping member to hold an end portion of the medium; a treatment liquid application device which applies treatment liquid to the medium held on the pressure drum circumferential surface; an image forming device which forms an image onto the medium on which the treatment liquid has been applied; and a cleaning device which includes: a wiper blade which is arranged along an axial direction of the pressure drum and wipes and removes the treatment liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction; a movement device which moves the wiper blade so as to separate the wiper blade from the pressure drum circumferential surface when the gripping member passes a wiping process position of the wiper blade; and a liquid pool removal device which removes at least a portion of the treatment liquid in a liquid pool formed by the treatment liquid that has been wiped by the wiper blade immediately before the wiper blade is separated from the pressure drum circumferential surface and that has not slid completely down the wiper blade face.

The image forming apparatus in an embodiment of the present invention includes an inkjet recording apparatus which forms an image on a recording medium by an inkjet method. Furthermore, the treatment liquid in an embodiment of the present invention includes an acidic liquid having a function of aggregating or insolubilizing a coloring material contained in an ink.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A cleaning device, comprising:

a wiper blade which is arranged along an axial direction of a pressure drum holding and conveying a medium on which liquid is applied, the pressure drum holding the medium on a pressure drum circumferential surface of the pressure drum and conveying the medium in a prescribed medium conveyance direction, the wiper blade wiping and removing the liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction;

a movement device which moves the wiper blade so as to separate the wiper blade from the pressure drum circumferential surface when a gripping member arranged on the pressure drum to hold an end portion of the medium passes a wiping process position of the wiper blade; and a liquid pool removal device which removes at least a portion of the liquid in a liquid pool formed by the liquid that has been wiped by the wiper blade immediately before the wiper blade is separated from the pressure drum circumferential surface and that has not slid completely down the wiper blade face.

2. The cleaning device as defined in claim 1, wherein the liquid pool removal device includes a doctor blade which is arranged along the axial direction of the pressure drum, the doctor blade removing at least a portion of the liquid in the liquid pool in one of a contact state and a non-contact proximate state with the pressure drum circumferential surface, the doctor blade being disposed in such a manner that a doctor blade face of the doctor blade is inclined from a normal to the pressure drum circumferential surface at a proximate position to the doctor blade face to form an angle of larger than 90° between the doctor blade face and the pressure drum circumferential surface on an upstream side from the proximate position in terms of the medium conveyance direction.

3. The cleaning device as defined in claim 2, wherein:

the doctor blade is disposed to an upstream side of the wiper blade in terms of the medium conveyance direction; and the movement device has a structure which unitedly separates the wiper blade and the doctor blade from the pressure drum circumferential surface.

4. The cleaning device as defined in claim 3, wherein the movement device separates the wiper blade and the doctor blade from the pressure drum circumferential surface after a recess section in the pressure drum circumferential surface in which the gripping member is disposed arrives at a wiping process position of the doctor blade and before the recess section arrives at the wiping process position of the wiper blade.

5. The cleaning device as defined in claim 4, wherein the movement device moves the wiper blade and the doctor blade in such a manner that the wiper blade is brought to contact with the pressure drum circumferential surface and the doctor blade is brought to the one of the contact state and the non-contact proximate state with the pressure drum circumferential surface, after the recess section passes the wiping process position of the wiper blade.

6. The cleaning device as defined in claim 2, wherein:

the doctor blade is disposed to a downstream side of the wiper blade in terms of the medium conveyance direction;

the movement device has a structure which severally separates the wiper blade and the doctor blade from the pressure drum circumferential surface; and at a timing that a recess section in the pressure drum circumferential surface in which the gripping member is disposed arrives at the wiping process position of the wiper blade, the movement device separates the wiper blade from the pressure drum circumferential surface and brings the doctor blade to the one of the contact state and the non-contact proximate state with the pressure drum circumferential surface to make the doctor blade remove at least a portion of the liquid in the liquid pool.

7. The cleaning device as defined in claim 2, wherein:

the doctor blade is disposed to a downstream side of the wiper blade in terms of the medium conveyance direction; and the movement device has a structure which unitedly moves the wiper blade and the doctor blade, and at a timing that a recess section in the pressure drum circumferential surface in which the gripping member is disposed arrives at the wiping process position of the wiper blade, the structure separates the wiper blade from the pressure drum circumferential surface and brings the doctor blade to the one of the contact state and the non-contact proximate state with the pressure drum circumferential surface.

8. The cleaning device as defined in claim 1, wherein a part of the pressure drum circumferential surface on an upstream side of a trailing end position of the medium of maximum size in terms of the medium conveyance direction is provided with a liquid repelling treatment.

9. The cleaning device as defined in claim 1, further comprising a wetting device which wets the pressure drum circumferential surface and is disposed to an upstream side of the wiper blade in terms of the medium conveyance direction.

10. The cleaning device as defined in claim 1, wherein the liquid pool removal device includes an absorbing device which is disposed to a downstream side of the wiper blade in terms of the medium conveyance direction and is brought to contact with the pressure drum circumferential surface to absorb and remove the liquid in the liquid pool.

11. The cleaning device as defined in claim 10, wherein the movement device has a structure which unitedly moves the wiper blade and the absorbing device, and at a timing that a recess section in the pressure drum circumferential surface in which the gripping member is disposed arrives at the wiping process position of the wiper blade, the structure separates the wiper blade from the pressure drum circumferential surface and brings the absorbing device to contact with the pressure drum circumferential surface.

12. A liquid application device, comprising:

a pressure drum which holds a medium on a pressure drum circumferential surface of the pressure drum and conveys the medium in a prescribed medium conveyance direction, the pressure drum having a gripping member to hold an end portion of the medium;

a liquid application unit which applies liquid to the medium held on the pressure drum circumferential surface; and a cleaning device which includes:

a wiper blade which is arranged along an axial direction of the pressure drum and wipes and removes the liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction;

a movement device which moves the wiper blade so as to separate the wiper blade from the pressure drum circumferential surface when the gripping member passes a wiping process position of the wiper blade; and a liquid pool removal device which removes at least a portion of the liquid in a liquid pool formed by the liquid that has been wiped by the wiper blade immediately before the wiper blade is separated from the pressure drum circumferential surface and that has not slid completely down the wiper blade face.

13. The liquid application device as defined in claim 12, wherein:

the liquid pool removal device includes a liquid receiving device which is arranged inside a recess section in the pressure drum circumferential surface in which the gripping member is disposed; and the liquid application device further comprises a movement control device which controls the movement device to separate the wiper blade from the pressure drum circumferential surface at a timing that the liquid receiving device arrives at the wiping process position of the wiper blade.

14. An image forming apparatus, comprising:

a pressure drum which holds a medium on a pressure drum circumferential surface of the pressure drum and conveys the medium in a prescribed medium conveyance direction, the pressure drum having a gripping member to hold an end portion of the medium;

a treatment liquid application device which applies treatment liquid to the medium held on the pressure drum circumferential surface;

an image forming device which forms an image onto the medium on which the treatment liquid has been applied; and a cleaning device which includes:

a wiper blade which is arranged along an axial direction of the pressure drum and wipes and removes the treatment liquid adhering to the pressure drum circumferential surface, the wiper blade being disposed in such a manner that a wiper blade face of the wiper blade is inclined from a normal to the pressure drum circumferential surface at a contact position with the wiper blade face to form an angle of smaller than 90° between the wiper blade face and the pressure drum circumferential surface on an upstream side from the contact position in terms of the medium conveyance direction;

a movement device which moves the wiper blade so as to separate the wiper blade from the pressure drum circumferential surface when the gripping member passes a wiping process position of the wiper blade; and a liquid pool removal device which removes at least a portion of the treatment liquid in a liquid pool formed by the treatment liquid that has been wiped by the wiper blade immediately before the wiper blade is separated from the pressure drum circumferential surface and that has not slid completely down the wiper blade face.

* * * * *